US006700086B2

(12) United States Patent
Serizawa et al.

(10) Patent No.: US 6,700,086 B2
(45) Date of Patent: Mar. 2, 2004

(54) FLEXIBLE SWITCH AND METHOD FOR PRODUCING THE SAME

(75) Inventors: Yasuyoshi Serizawa, Susono (JP); Minoru Kubota, Susono (JP); Keizo Nishitani, Susono (JP); Kenichiro Kawaguchi, Susono (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/212,811

(22) Filed: Aug. 7, 2002

(65) Prior Publication Data

US 2003/0029709 A1 Feb. 13, 2003

(30) Foreign Application Priority Data

| | | |
|---|---|---|
| Aug. 8, 2001 | (JP) | P2001-240198 |
| Aug. 8, 2001 | (JP) | P2001-241313 |
| Aug. 10, 2001 | (JP) | P2001-244551 |
| Nov. 21, 2001 | (JP) | P2001-356153 |

(51) Int. Cl.[7] ..... H01H 1/10
(52) U.S. Cl. ..... 200/512; 200/516
(58) Field of Search ..... 200/6 A, 5 A, 200/510–520, 314–341, 302.2, 344, 85 R, 5 R, 17 R, 18, 406

(56) References Cited

U.S. PATENT DOCUMENTS

| | | | | |
|---|---|---|---|---|
| 4,194,097 A | * | 3/1980 | Bradam | 200/5 A |
| 4,409,450 A | * | 10/1983 | Blades | 200/512 |
| 4,551,586 A | * | 11/1985 | Latasiewicz | 200/5 A |
| 4,555,601 A | * | 11/1985 | Taguchi | 200/5 A |
| 4,639,559 A | * | 1/1987 | Taguchi | 200/5 A |
| 5,193,669 A | * | 3/1993 | Demeo et al. | 200/512 |
| 5,924,555 A | * | 7/1999 | Sadamori et al. | 200/512 |
| 6,069,552 A | * | 5/2000 | Van Zeeland | 338/92 |
| 6,552,289 B2 | * | 4/2003 | Kawaguchi et al. | 200/512 |
| 6,603,086 B2 | * | 8/2003 | Kawaguchi et al. | 200/517 |
| 6,617,536 B2 | * | 9/2003 | Kawaguchi | 200/516 |

FOREIGN PATENT DOCUMENTS

| | | |
|---|---|---|
| JP | 63127875 | * 5/1988 |
| JP | 2405944 | * 12/1990 |

* cited by examiner

*Primary Examiner*—Michael Friedhofer
*Assistant Examiner*—Lisa Klaus
(74) *Attorney, Agent, or Firm*—Sughrue, Mion, PLLC

(57) ABSTRACT

In a flexible switch, a circuit member having an electrode is provided on a adhesive sheet. A spacer sheet, having a through hole situated so as to correspond to the electrode on the circuit member, is provided on the circuit member. A front sheet, having a projected portion, is provided on the spacer sheet, in which a contact portion provided on an inner face of the projected portion is brought into contact with the electrode through the through hole in the circuit member when the projected portion is depressed. At least one of the adhesive sheet, the circuit member, the spacer sheet, and the front sheet has flexibility.

15 Claims, 30 Drawing Sheets

FLEXIBLE SWITCH AND METHOD FOR PRODUCING THE SAME

BACKGROUND OF THE INVENTION

This invention relates to a flexible switch comprising a front sheet, having dome-like projected portions, a spacer sheet, a circuit member, and an adhesive sheet and a method for the flexible switch.

FIGS. 35 and 36 show the first embodiment of a related switch. In FIGS. 35 and 36, this related switch comprises a board 411, having a switching circuit (not shown) formed on a face thereof, an integral-type rubber switch unit 415, an integral-type key top unit 420, and a casing 413. The board 411, the integral-type rubber switch unit 415 and the integral-type key top unit 420 are fixedly secured by screws 412 to the casing 413 in a generally laminated manner.

With respect to the integral-type rubber switch unit 415, reference numeral 416 denotes rubber switch portions, reference numeral 416*a* denotes a flaring portion, and reference numeral 416*b* denotes an electrode. With respect to the integral-type key top unit 420, reference numeral 421 denotes key tops, reference numeral 422 denotes a numeral, a character, a sign or the like, reference numeral 423 denotes an arm, reference numeral 424 denotes a frame, reference numeral 424*a* denotes a longitudinal frame portion, and reference numeral 424*b* denotes a transverse frame portion. With respect to the casing 413, reference numeral 413*a* denotes openings.

FIGS. 37 and 38 show the second embodiment of a related switch. In FIG. 37, a plurality of switches 2 to 6 are mounted on an instrument panel 1 (which is one of component parts of an automobile), and are disposed at suitable positions around indicating meters 7. For example, the construction of the switch 2 will be described with reference to FIG. 38. This switch 2 comprises a circuit member 8, rubber switches 9 and 9, key tops 10, and a bezel 11.

The circuit member 8 comprises a rigid board 12, and a plurality of circuits 13 are formed on this board in desired patterns. Contacts 14 for the rubber switches 19, as well as a plurality of electrical function parts 15, are provided on the circuits 13. In FIG. 38, reference numeral 16 denotes an FFC, and reference numeral 17 denotes a connection portion of this FFC 16.

In the above construction, the circuit member 8 is mounted on the inside of the instrument panel 1 through the rigid board 12. The rubber switches 9 and 9 are mounted respectively on the contacts 14 and 14 on the circuit member 8. Further, the key tops 10 are mounted on the rubber switches 9 and 9, and then the bezel 11 is mounted on these key tops. The bezel 11 is fitted in an opening formed in the instrument panel 1. Design portions 18 are formed on the faces of the key tops 10 and bezel 11 by printing, ornamentation or the like.

The above first embodiment of the related switch has the following problems.

Firstly, the overall structure is complicated, and the thickness of the main component members in the laminating direction is large, and most of the parts are made of rigid materials, and therefore there are encountered problems that it is difficult to achieve the thin/lightweight design of the switch and that the degree of freedom with respect to the configuration is almost zero.

Secondly, there is encountered a problem that a region where the switch is installed (or mounted) is limited to a portion where a large receiving space or a flat-face configuration is available.

Thirdly, there is encountered a problem that the special and cumbersome fixing, utilizing locks, screws or the like, is required.

Next, in the above second embodiment of the related switch, when it is necessary to change the design portions 18, the printing, ornamentation or the like for the key tops 10 and the bezel 11 must be changed, and therefore there is encountered a problem that this change is complicated. For example, in the case where it is necessary to provide variations in accordance with the grade of an automobile, the design portions 18 must be changed in accordance with this variation, which invites a problem that the change becomes more complicated.

And besides, in the above related switch, the switch 2 (like the other switches 3 to 6) is thick, and therefore there is encountered a problem that the switch 2 can not be installed unless a large receiving space is provided at the inside of the instrument panel 1. Naturally, this problem is also encountered with the installation of an optional switch.

Furthermore, the above related switch has a problem that the switch 2 (like the other switches 3 to 6) can not be installed unless there is provided a flat face having no two-dimensional/three-dimensional face (In other words, there is encountered a problem that the installation portion is limited.).

SUMMARY OF THE INVENTION

It is therefore an object of the present invention to provide a flexible switch and a method for producing the same which increases the installation range, and has a thin/lightweight design and a high degree of freedom for the configuration, and facilitates the mounting, and enables the space-saving, and enable to reflects the design change and model change of a machine and motor or a like.

In order to achieve the above object, according to the present invention, there is provided a flexible switch comprising:

an adhesive sheet;

a circuit member, provided on the adhesive sheet, and having an electrode;

a spacer sheet, provided on the circuit member, and having a through hole situated so as to correspond to the electrode on the circuit member; and a front sheet, provided on the spacer sheet, and having a projected portion, in which a contact portion provided on an inner face of the projected portion is brought into contact with the electrode through the through hole in the circuit member when the projected portion is depressed; and wherein at least one of the adhesive sheet, the circuit member, the spacer sheet, and the front sheet has flexibility.

Preferably, a form of the projected portion is shaped into a hemisphere.

Preferably, the flexible switch further comprising an external connection member, for electrically connecting the circuit member to an external member, and the external connection member provided on the circuit member.

Preferably, the external member is at least one of an automotive component and an automotive accessory.

In this configurations, when the projected portion is depressed, and is inverted inwardly, the electrode on the inner face of the projected portion is brought into contact with the contact on the circuit member through the through hole in the spacer sheet, so that the conductive condition is obtained. When the depressing of the projected portion is canceled, so that this projected portion is restored into its original condition, the conductive condition is canceled. Here, the spacer sheet functions as a member for preventing the excess deformation of the front sheet. The flexible switch includes the adhesive sheet, and has flexibility, and the circuit member has the external connection member. Therefore, the installation region is not limited to a portion where a large receiving space or a flat face-configuration is available, but the switch can be installed or mounted on a portion, such for example as a curved face. And besides, the fixing of the switch is effected merely by bonding the adhesive fixing face to the mounting member, and therefore the switch can be easily mounted.

Therefore, there can be provided the flexible switch of the invention in which the switch operating functions are obtained with the small construction and the simple structure, and besides the installation range is increased, and the thin/lightweight design is achieved, and the degree of freedom for the configuration is enhanced, and the mounting is easy.

Here, it is preferable that, the external connection member includes at least one of an edge connector terminal and a connector.

In this configuration, the electrical connection to the exterior is effected via the edge connector terminal or the connector.

Here, it is preferable that, the external connection member includes a wire connection circuit portion.

In this configuration, the electrical connection to the exterior is effected within the range of the length of the wire connection circuit portion extending outwardly from the circuit member body.

Preferably, the circuit member is provided on a first face of the adhesive sheet; and a second face of the adhesive sheet opposed to the first face is covered with a release paper sheet.

In this configuration, the second face of the adhesive sheet is protected until the flexible switch is finally used. And besides, the flexible switch can be carried, with the release paper sheet provided on the second face of adhesive sheet.

Preferably, the front sheet is transparent.

Preferably, the front sheet is provided with an compatible external appearance portion; and the compatible external appearance portion is provided on at least one of an inner face and an outer face of the front sheet.

In this configuration, the molded, transparent member is used as the front sheet, and the compatible external appearance portion, reflected the variations of design change and model change, is provided on the inner face of the front sheet, and the design change and the model change can be easily effected by replacing only the front sheet.

Preferably, at least one flat member situated so as to correspond to the through holes is provided on the front sheet.

Here, it is preferable that, the front sheet is transparent, and the compatible external appearance portion, formed on the inner face of the front sheet, is at least one of a printed portion and an ornamented portion.

In this configuration, the printing portion and/or the ornamented portion are changed by selecting the front sheet provided with the compatible external appearance portion, so that the variation-meeting range which is range of the design change and the model change can be increased.

Here, it is preferable that, the compatible external appearance portion includes a coating layer made of a synthetic resin, and the coating layer is formed on the projected portion of the front sheet.

In this configuration, the coating layer imparts a variation to the touch of the projected portion, and therefore the variation-meeting range can be further increased.

Here, it is preferable that, the compatible external appearance portion includes a sheet cover member and a depressing portion;

wherein the sheet cover member covers the outer face of the front sheet;

wherein the depressing portion is integrally formed with the sheet cover member; and wherein the projected portion is accommodated in an inner side of the depressing portion.

In this configuration, the sheet cover member and depressing portion are changed by selecting the front sheet provided with the compatible external appearance portion, so that the variation-meeting range can be increased.

Here, it is preferable that, the compatible external appearance portion includes a key top member and a cover member;

wherein the key top member depresses the projected portion when the key top member is depressed; and wherein the cover member covers the outer face of the front sheet while holding the key top member.

In this configuration, the member and the key top member are changed by selecting the front sheet provided with the compatible external appearance portion, so that the variation-meeting range can be increased.

Preferably, the flexible switch is attached on at least one of automotive components, and the automotive mounting portions include a face of a panel, a recess portion in the panel, an opening-closing member, a front face of an accessory, and a steering wheel.

In this configuration, the flexible switch can be mounted on at least one of the face of the panel, the recess portion in the panel, the opening-closing member, the front face of the accessory, and the steering wheel when this mounting portion has a two-dimensional/three-dimensional face.

Preferably, the front sheet serves for a bezel.

In this configuration, when the flexible switch is mounted on a mounting portion, the front sheet functions also as the bezel.

According to the present invention, there is also provided a method for producing a flexible switch, comprising the steps of:

providing an adhesive sheet, a circuit member having an electrode, and a spacer sheet having a through hole situated so as to correspond to the electrode on the circuit member, used respectively as common members; and providing a first compatible front sheet having a first projected portion and a first external appearance;

providing a second compatible front sheet having a second projected portion and a second external appearance different from the first external appearance;

selecting either the first compatible front sheet or the second compatible front sheet in accordance with a design change and a model change;

mounting the circuit member on the adhesive sheet;

mounting the spacer sheet on the circuit member; and mounting either the first compatible front sheet or the second compatible front sheet which is selected in the selecting step accordance with the design change and the model, on the spacer sheet.

In this method, the flexible switch can easily reflect the design change and the model change by selecting either the first compatible front sheet or the second compatible front sheet in the selecting step.

According to the present invention, there is also provided a flexible switch, comprising:

an adhesive sheet;

a first circuit member, provided on the adhesive sheet, and having a first electrode;

a first spacer sheet, provided on the first circuit member, and having a first through hole situated so as to correspond to the first electrode on the first circuit member;

a second circuit member, provided on the first spacer sheet, and having a second electrode situated so as to correspond to the first electrode of the first circuit member;

a second spacer sheet, provided on the second circuit member, and having a second through hole situated so as to correspond to the first electrode of the first circuit member; and a front sheet, provided on the second spacer sheet, and having a projected portion situated so as to correspond to the second electrode of the second circuit member, wherein the second circuit member is depressed by the projected portion through the second through hole so as to bend the second circuit member when the projected portion is depressed, so that the second electrode on the second circuit member is brought into contact with the first electrode through the first through hole; and wherein at least one of the adhesive sheet, the first circuit member, the first spacer sheet, the second circuit member, the second spacer sheet, and the front sheet has flexibility.

Preferably, the second circuit member has an elastic member situated so as to correspond to the first electrode of the first circuit member; and wherein the elastic member is depressed together with the second circuit member by the projected portion when the projected portion is depressed.

Preferably, a form of the projected portion is shaped into a hemisphere.

Preferably, the flexible switch further comprising an external connection member, for electrically connecting the first circuit member to an external member, and the external connection member provided on the first circuit member.

Preferably, the flexible switch further comprising an external connection member, for electrically connecting the second circuit member to an external member, and the external connection member provided on the second circuit member.

Preferably, the external member is at least one of an automotive component and an automotive accessory.

In this configurations, when the projected portion is depressed, and is inverted inwardly, the second circuit member is depressed by the projected portion through the second through hole so as to bend the second circuit member, so that the second electrode on the second circuit member is brought into contact with the first electrode through the first through hole in the first spacer sheet. Therefore the conductive condition is obtained. When the depressing of the projected portion is canceled, so that this projected portion is restored into its original condition, the conductive condition is canceled. Here, the second spacer sheet functions as a member for preventing the excess deformation of the front sheet. The flexible switch includes the adhesive sheet, and has flexibility, and the first and second circuit member has the external connection member. Therefore, the installation region is not limited to a portion where a large receiving space or a flat face-configuration is available, but the switch can be installed or mounted on a portion, such for example as a curved face. And besides, the fixing of the switch is effected merely by bonding the adhesive fixing face to the mounting member, and therefore the switch can be easily mounted.

Therefore, there can be provided the flexible switch of the invention in which the switch operating functions are obtained with the small construction and the simple structure, and besides the installation range is increased, and the thin/lightweight design is achieved, and the degree of freedom for the configuration is enhanced, and the mounting is easy.

Here, it is preferably that, the external connection member includes at least one of an edge connector terminal and a connector.

In this configuration, the electrical connection to the exterior is effected via the edge connector terminal or the connector.

Here, it is preferable that, the external connection member includes a wire connection circuit portion.

In this configuration, the electrical connection to the exterior is effected within the range of the length of the wire connection circuit portion extending outwardly from the circuit member body.

Preferably, the first circuit member is provided on a first face of the adhesive sheet; and wherein a second face of the adhesive sheet opposed to the first face is covered with a release paper sheet.

In this configuration, the second face of the adhesive sheet is protected until the flexible switch is finally used. And besides, the flexible switch can be carried, with the release paper sheet provided on the second face of adhesive sheet.

Preferably, the front sheet is transparent.

Preferably, the front sheet is provided with an compatible external appearance portion; and wherein the compatible external appearance portion is provided on at least one of an inner face and an outer face of the front sheet.

In this configuration, the molded, transparent member is used as the front sheet, and the compatible external appearance portion, reflected the variations of design change and model change, is provided on the inner face of the front sheet, and the design change and the model change can be easily effected by replacing only the front sheet.

Preferably, at least one flat member situated so as to correspond to the second through holes is provided on the front sheet.

Here, it is preferable that, the front sheet is transparent; and wherein the compatible external appearance portion, formed on the inner face of the front sheet, is at least one of a printed portion and an ornamented portion.

In this configuration, the printing portion and/or the ornamented portion are changed by selecting the front sheet provided with the compatible external appearance portion, so that the variation-meeting range which is range of the design change and the model change can be increased.

Here, it is preferable that, the compatible external appearance portion includes a coating layer made of a synthetic resin; and wherein the coating layer is formed on the projected portion of the front sheet.

In this configuration, the coating layer imparts a variation to the touch of the projected portion, and therefore the variation-meeting range can be further increased.

Here, it is preferable that, the compatible external appearance portion includes a sheet cover member and a depressing portion;

wherein the sheet cover member covers the outer face of the front sheet;

wherein the depressing portion is integrally formed with the sheet cover member; and wherein the projected portion is accommodated in an inner side of the depressing portion.

In this configuration, the sheet cover member and depressing portion are changed by selecting the front sheet provided with the compatible external appearance portion, so that the variation-meeting range can be increased.

Here, it is preferable that, the compatible external appearance portion includes a key top member and a cover member;

wherein the key top member depresses the projected portion when the key top member is depressed; and wherein the cover member covers the outer face of the front sheet while holding the key top member.

In this configuration, the member and the key top member are changed by selecting the front sheet provided with the compatible external appearance portion, so that the variation-meeting range can be increased.

Preferably, the flexible switch is attached on at least one of automotive components, and wherein the automotive mounting portions include a face of a panel, a recess portion in the panel, an opening-closing member, a front face of an accessory, and a steering wheel.

In this configuration, the flexible switch can be mounted on at least one of the face of the panel, the recess portion in the panel, the opening-closing member, the front face of the accessory, and the steering wheel when this mounting portion has a two-dimensional/three-dimensional face.

Preferably, the front sheet serves for a bezel.

In this configuration, when the flexible switch is mounted on a mounting portion, the front sheet functions also as the bezel.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
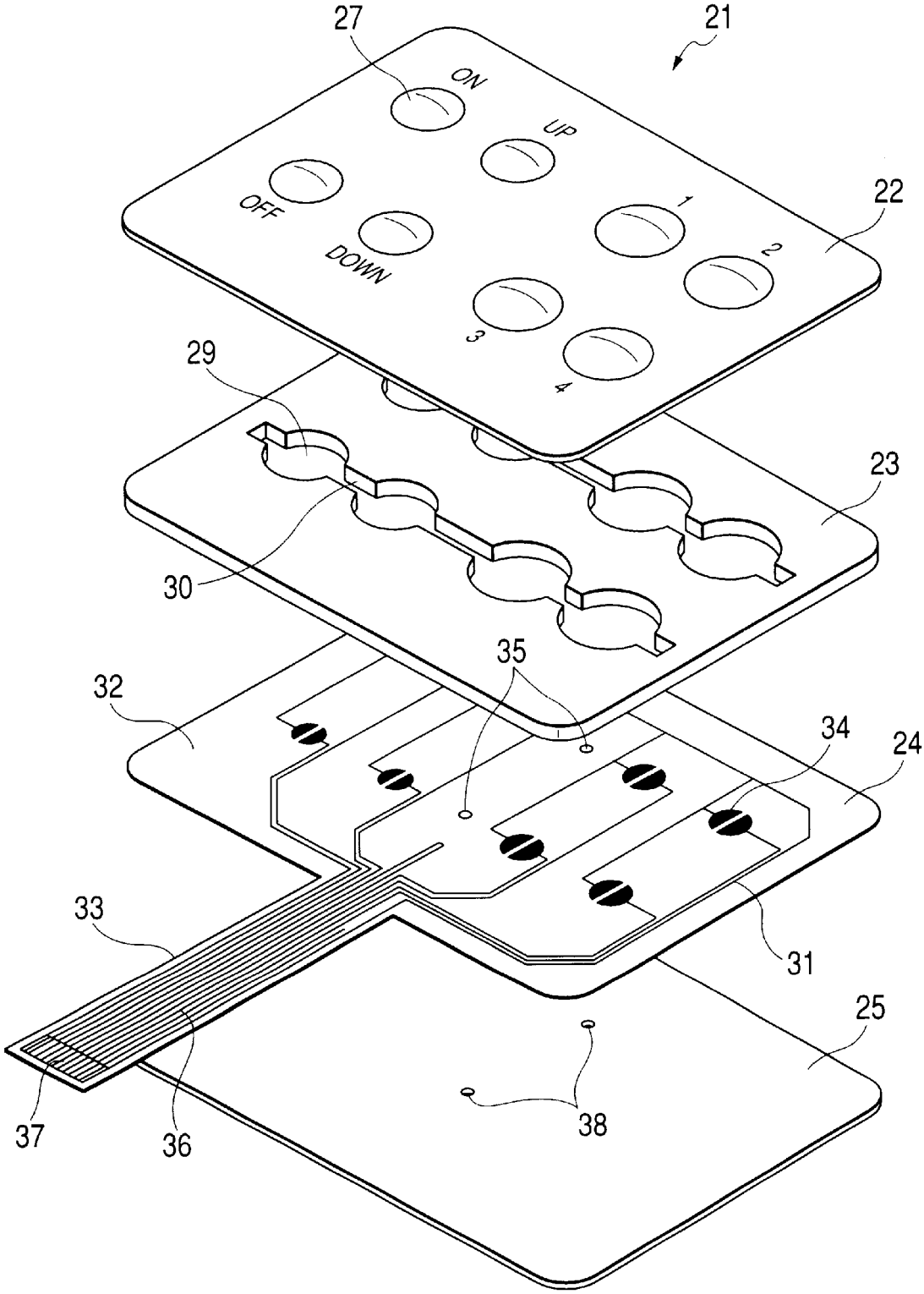
FIG. 1 is an exploded perspective view of one preferred embodiment of a dome switch of the present invention.
Figure 2:
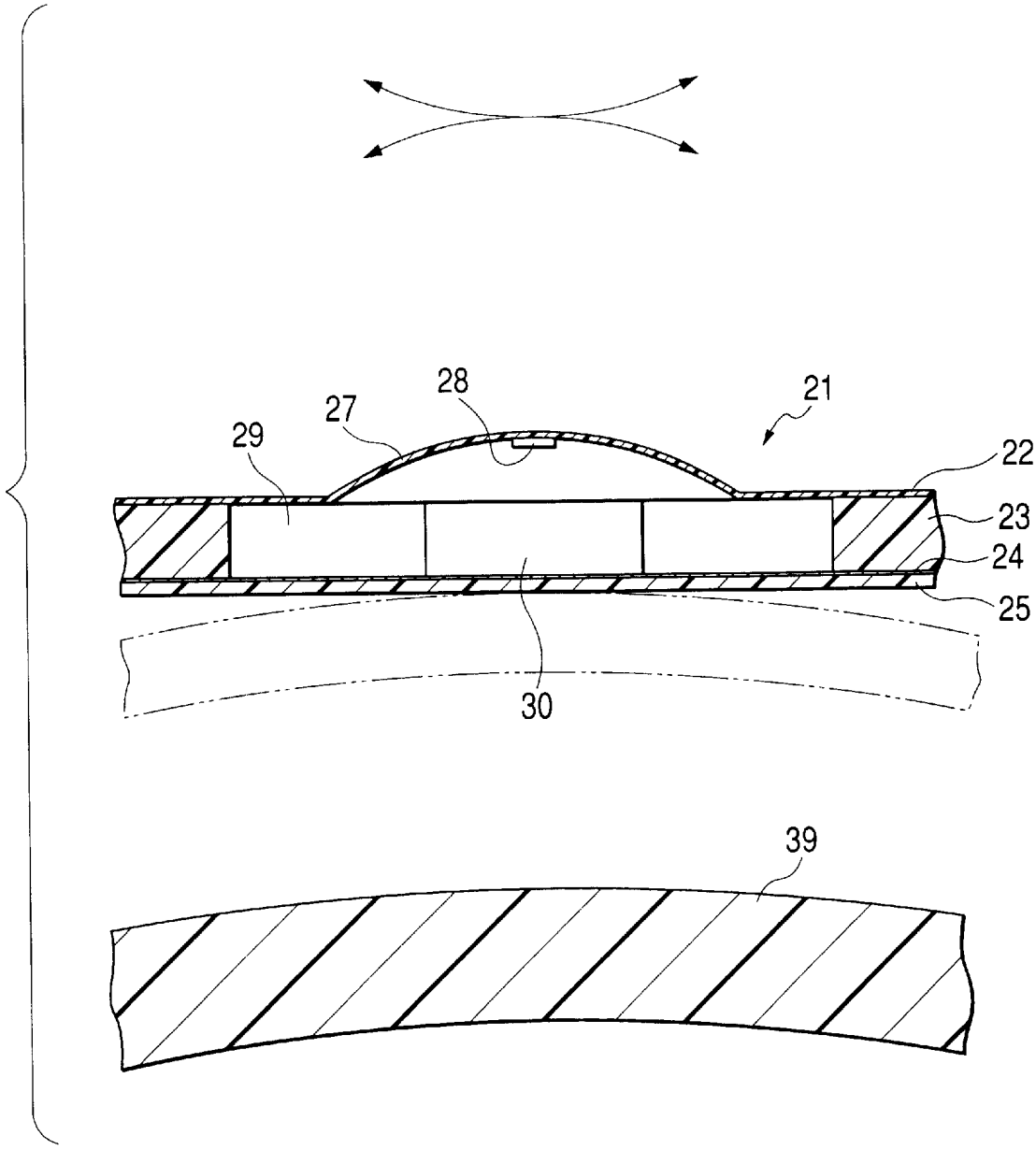
FIG. 2 is a cross-sectional view explanatory of the flexibility.
Figure 3:
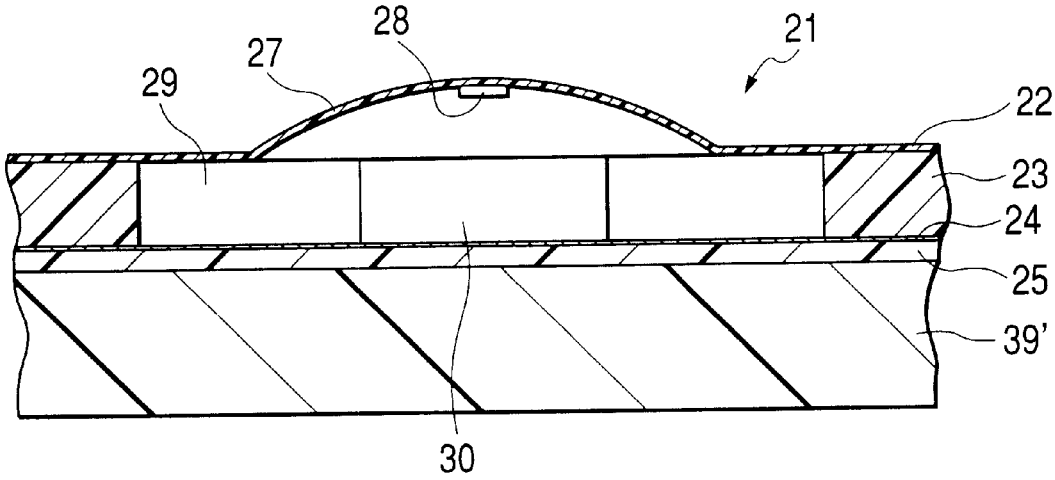
FIG. 3 is a cross-sectional view of the switch in an inoperative condition.
Figure 4:
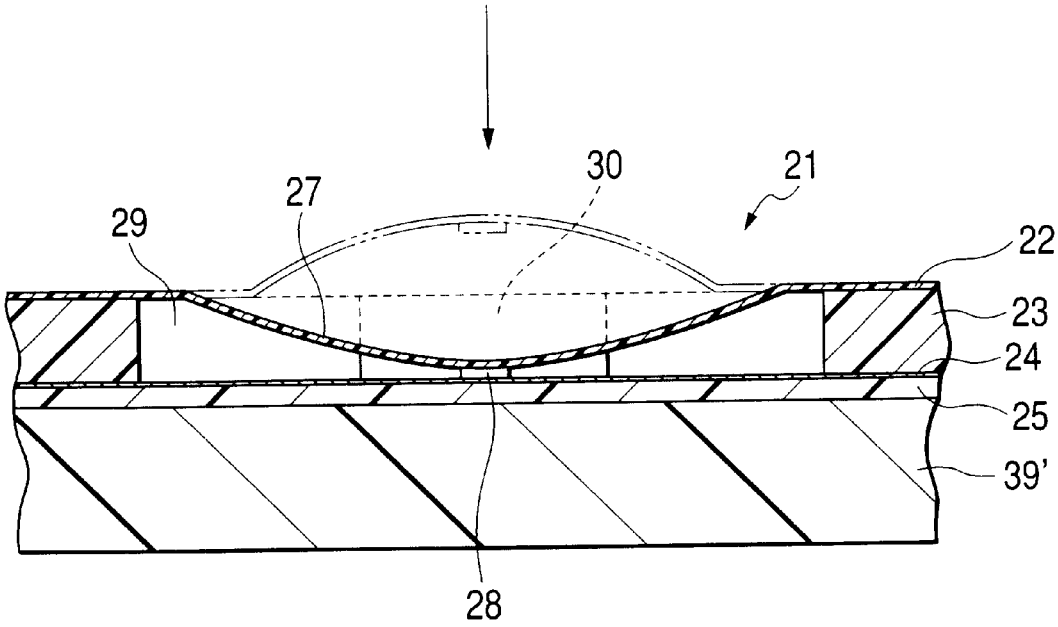
FIG. 4 is a cross-sectional view of the switch in an operated condition.

A preferred embodiment of the present invention will be described below with reference to the drawings. FIG. 1 is an exploded perspective view of the first preferred embodiment of a dome switch of the invention. FIG. 2 is a cross-sectional view explanatory of the flexibility. FIG. 3 is a cross-sectional view showing a condition before the switch is operated. FIG. 4 is a cross-sectional view showing a condition when the switch is operated.

In FIG. 1, the poly-dome switch 21 comprises a front (obverse) sheet 22, a spacer sheet 23, a FPC (flexible printed circuit) 24, and an adhesive sheet 25. The poly-dome switch 21 of the present invention has flexibility, and has an external connector 33 (described later) provided at the FPC 24. And besides, the poly-dome switch 21 of the invention has a thin/lightweight design, and can be mounted on a desired portion, such as a curved face, according to the need of the user.

First, the above constituent members will be described in detail, and then the assemblage and operation of the poly-dome switch 21 will be described.

The front sheet 22 is transparent, and has flexibility, and a plurality of projected portions 27 are formed on this front sheet. Each of the projected portions 27 has a dome-shape, and is projected outwardly, and can be inverted inwardly. An electrode 28 (see FIG. 2) for the FPC 24 is provided on the inner face of each projected portion 27. The electrode 28 (see FIG. 2) is provided at the apex of this inner face.

The front sheet 22 will be described in a little more detail, and this front sheet 22 is a transparent sheet member made of a synthetic resin such for example as polyethylene terephthalate (PET), and has the plurality of dome-like projected portions 27 formed by hot pressing (in which a pressure is applied from the inner side toward the outer side) applied to the sheet member. The electrode 28, formed on the apex of the inner face of each dome-like projected portion 27, is made of carbon or the like (In the case where the electrode 28 is made of carbon, the electrode is formed by printing.) [A0021]

The front sheet 22 is made of the synthetic resin, and therefore is transparent color, and in this embodiment, for example, characters "ON", "OFF", "UP" and "DOWN", and figures "1" to "4" are printed in white color on the inner face of the front sheet (These characters and figures are printed near to the projected portions 27, respectively.). A background color (for example, black color) is also printed on this inner face (The electrode 28 made of carbon is formed, after these are printed.).

The spacer sheet 23 is a flexible sheet member made of a synthetic resin such for example as polyethylene terephthalate (PET), and this spacer sheet functions to prevent the excess deformation of the front sheet 22. The spacer sheet 23 also functions to secure the stroke dimension for the projected portions 27(The stroke dimension is equal to a depressing dimension of the projected portions 27.).

In this embodiment, the spacer sheet 23 is formed into a sheet-shape, and has a thickness which is equal, for example, to about a half of the maximum stroke of each projected portion 27. For example, the thickness of the front sheet 22 (except the height of each projected portion 27) is 125 $\mu$m, and the maximum stroke of the projected portion 27 is 1.5 mm (The height of the projected portion 27, contained in this value, is 750 $\mu$m), and the thickness of the spacer sheet 23 is 750 $\mu$m.

The spacer sheet 23 will be described in a little more detail, and this spacer sheet 23 has adhesive layers (not shown) formed respectively on the obverse and reverse faces thereof, and the front sheet 22 and the FPC 24 can be fixed to the obverse and reverse faces of the spacer sheet 23, respectively. The spacer sheet 23 has a plurality of through holes 29 and a plurality of air escape portions 30, and allows each inverted projected portion 27 to pass therethrough, and the air, existing in the inner side of each projected portion 27, is caused to escape when the projected portion 27 is inverted.

The through holes 29 are disposed at a position corresponding to the projected portions 27, respectively. Each through hole 29 has a diameter larger than the diameter of the corresponding projected portion 27 (see FIG. 2. The diameter of the through hole may be equal to the diameter of the projected portion 27.). Each air escape portion 30 has a slit-like shape, and is formed between the corresponding adjacent through holes 29 arranged in the longitudinal direction of the spacer sheet 23. Each air escape portion 30 communicates with the corresponding through holes 29.

The FPC 24 (FPC: a flexible printed circuit) comprises a circuit member body 32, having a plurality of circuits 31 formed thereon in desired patterns, and the external connector 33 for electrical connection to the exterior.

A plurality of contacts 34, with which the electrodes 28 (see FIG. 2) can be brought into contact, respectively, are formed on that side of the circuit member body 32 facing the spacer sheet 23. Air escape holes 35, which communicate respectively with the corresponding air escape portions 30 in the spacer sheet 23, are formed respectively through those portions of the circuit member body 32 disposed in the vicinity of a central portion thereof. In this embodiment, the thickness of the FPC 24 is 100 $\mu$m. It is not limited to the FPC (FPC 24), if the flexibility should not be adversely affected.

The external connector 33 comprises a wire connection circuit portion 36, extending outwardly from the circuit member body 32, and a plurality of edge connector terminals 37 provided at a distal end of the wire connection circuit portion 36. The wire connection circuit portion 36 has a suitable length, and the circuits 31, extending from the circuit member body 32, are arranged on this wire connection circuit portion 36. The circuits 31, extending from the circuit member body 32, are connected respectively to the corresponding edge connector terminals 37.

The adhesive sheet 25 is so designed that the FPC 24 can be adhesively bonded and fixed to this adhesive sheet 25. More specifically, one side of the adhesive sheet 25 serves as a circuit member-mounting face for the FPC 24. The other side of the adhesive sheet 25 serves as an adhesive fixing face for various mounting members described later.

The adhesive sheet 25 has air escape holes 38 which are similar to the air escape holes 35 in the FPC 24, and communicate with these holes 35, respectively. These air escape holes 38 are so formed as to allow the air to escape to a space in the mounting member if such a space is provided in the mounting member.

A release paper sheet (not shown) is provided on the adhesive fixing face of the adhesive sheet 25. This release paper sheet (not shown) serves to protect this adhesive fixing face until the switch is finally used, and this release paper sheet also enables the carrying of the poly-dome switch 21.

The adhesive sheet 25 can function as a reinforcing member in so far as it will not adversely affect the flexibility of the poly-dome switch 21.

In the above construction, the poly-dome switch 21 is assembled in the following manner, First, the front sheet 22 is adhesively bonded to the obverse face of the spacer sheet 23, and the FPC 24 is adhesively bonded to the reverse face of the spacer sheet 23. Then, this laminate is affixed to the adhesive sheet 25, with the FPC 24 adhesively bonded to the circuit member-mounting face of the adhesive sheet 25, thereby assembling the poly-dome switch.

The thus assembled poly-dome switch 21 has flexibility as described above, and therefore can be easily bent, for example, in directions of arrows in FIG. 2. And besides, the poly-dome switch can be mounted, for example, on a curved face of a mounting member 39 as shown in FIG. 2. When the poly-dome switch is to be installed, the release paper sheet (not shown) is removed from the adhesive sheet 25, and then the above-mentioned adhesive fixing face is bonded to the curved face over an entire area thereof in intimately-contacted relation to this curve face.

Next, the operation of the poly-dome switch 21, mounted on a flat mounting member 39', will be described with reference to FIGS. 3 and 4.

In an inoperative condition of the switch in which a load is not applied to any projected portion 27 as shown in FIG. 3, the projected portion 27 is held in its original shape because of its own shape retention.

When the switch is operated, that is, the projected portion 27 is depressed in a direction of an arrow in FIG. 4 (a load is applied in the direction of the arrow), the projected portion 27 resists the load, acting in the direction of the arrow, and then is buckled to be inverted when this load exceeds a certain value (At this time, a click feeling is obtained). When the projected portion 27 is buckled and inverted, the load, acting in the direction of the arrow, decreases, so that the depressing of the projected portion 27 proceeds smoothly. The inverted projected portion 27 passes through the through hole 29 in the spacer sheet 23, and the electrode 28, formed on the projected portion 27, is brought into contact with the contact 34 (see FIG. 1) on the FPC 24 through the through hole 29.

As a result, the circuits 31 (see FIG. 1) are rendered conductive, and the poly-dome switch 21 is turned on. On the other hand, when the application of the load in the direction of the arrow is canceled, the projected portion 27 is restored into its original shape. As a result, the conductive condition is canceled, so that the poly-dome switch 21 is turned off.

The poly-dome switch 21 of this embodiment can achieve the switch operating functions, similar to those of the related switch, with the small construction and simple structure, and therefore the thin/lightweight design of the switch can be achieved, and also the degree of freedom for the configuration can be enhanced. And besides, the thin design is much more enhanced as compared with the related structure, and therefore the space-saving at the mounting member can be achieved, and a through opening for mounting the related switch does not need to be provided (This leads to the increased rigidity of the mounting member and also to the enhanced productivity.). Furthermore, the poly-dome switch is provided with the adhesive sheet 25, and has flexibility, and the FPC 24 has the external connector 33, and therefore the installation range can be increased as compared with the related structure, and the mounting of the switch on the mounting member can be effected easily.

In this embodiment, the thickness of the spacer sheet 23 can be increased to such an extent as not to adversely affect the flexibility, thereby securing the necessary stroke dimension, and such that the stroke of each projected portion 27 can be increased (In other words, the required stroke of the projected portion 27 during the operation of the switch can be determined by the thickness of the spacer sheet 23.).

Figure 5:
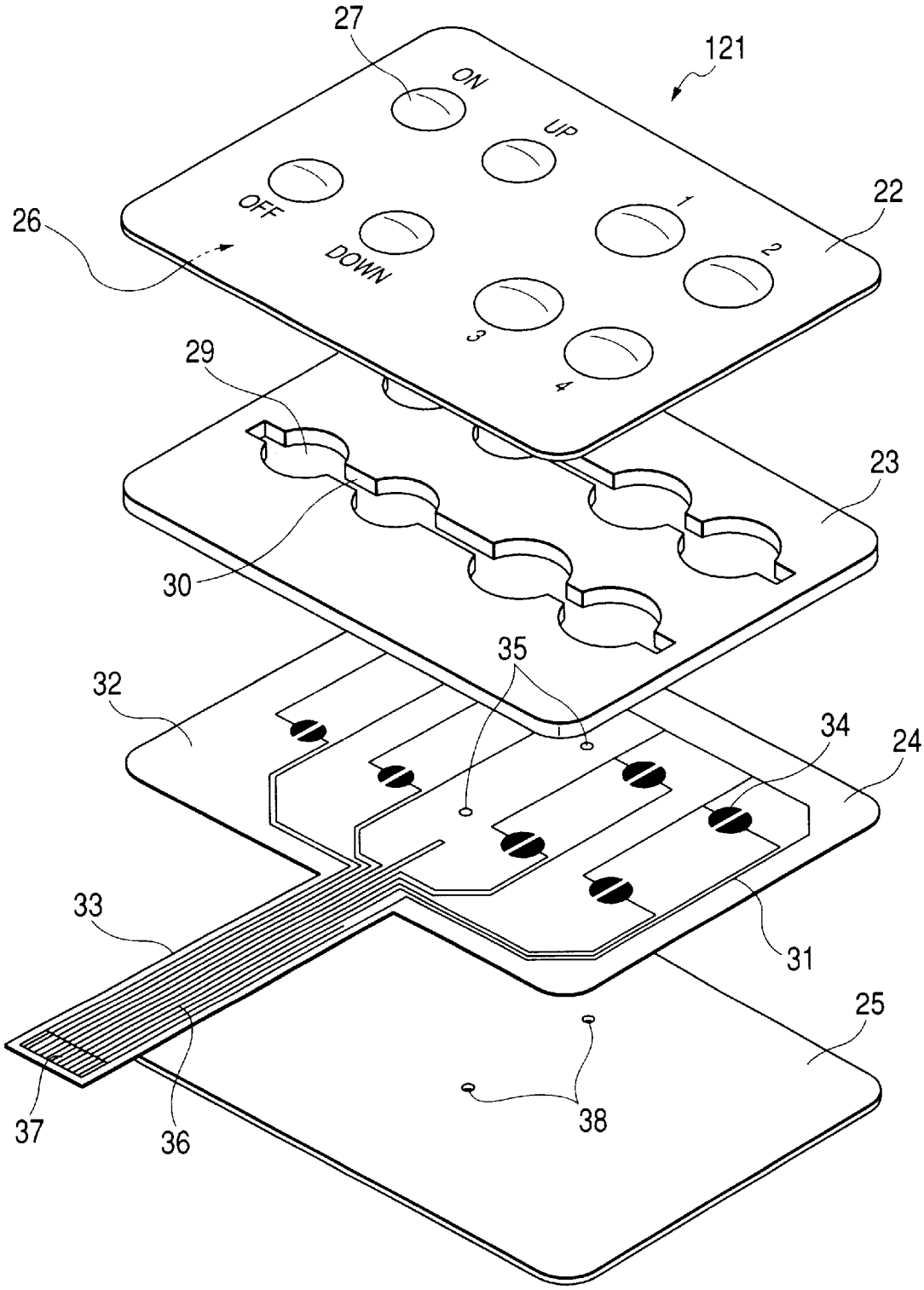
FIG. 5 is an exploded perspective view of one preferred embodiment of a variation-meeting dome switch of the present invention.
Figure 6:
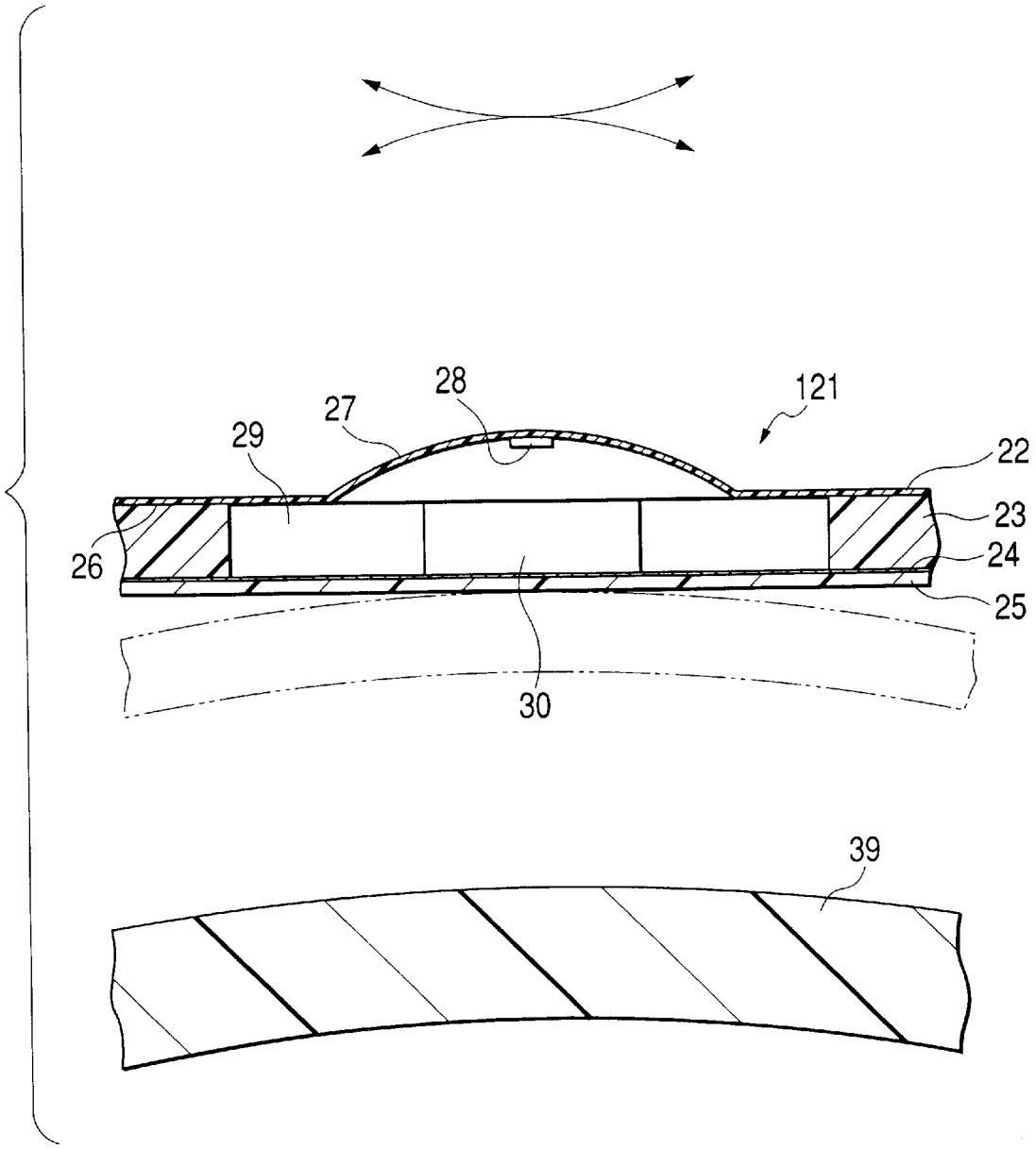
FIG. 6 is a cross-sectional view explanatory of the flexibility.
Figure 7:
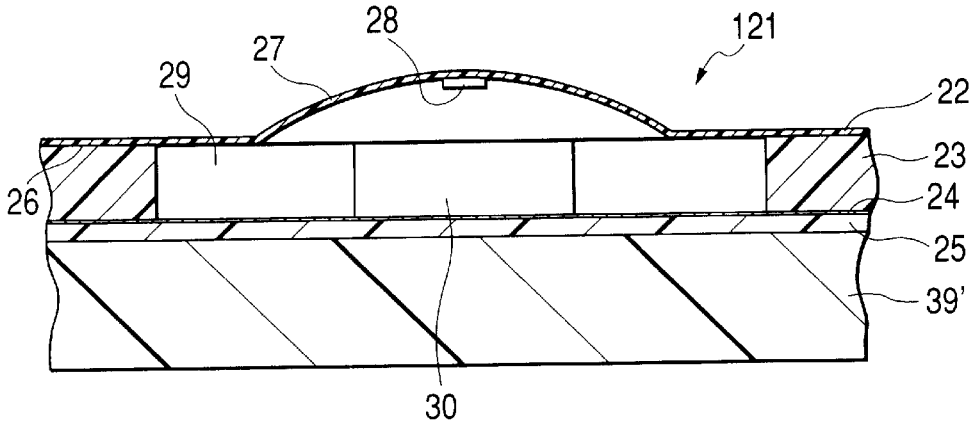
FIG. 7 is a cross-sectional view of the switch in an inoperative condition.
Figure 8:
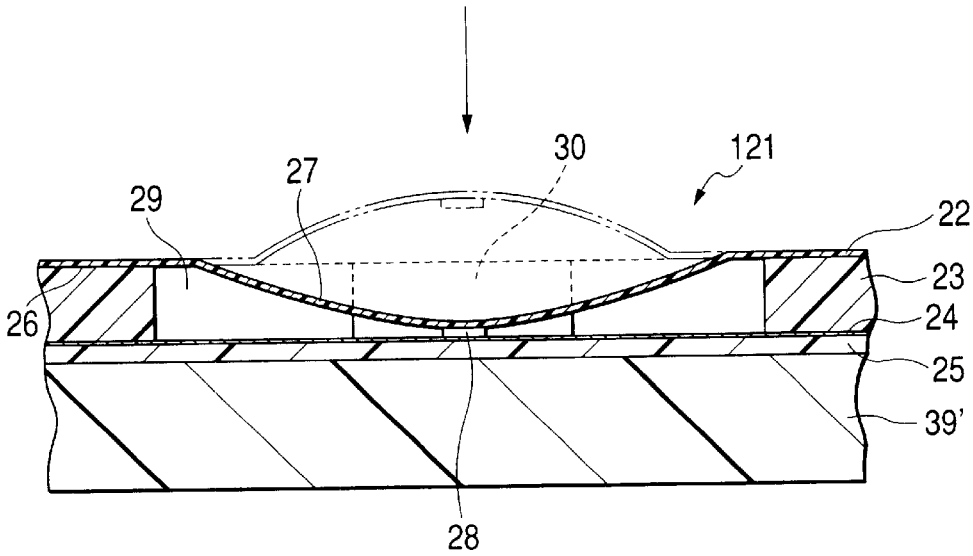
FIG. 8 is a cross-sectional view of the switch in an operated condition.

Next, the poly-dome switch of the second embodiment according to the present invention will be described below with reference to FIG. 5 to FIG. 8. FIG. 5 is an exploded perspective view of the second preferred embodiment of a variation-meeting dome switch of the invention. FIG. 6 is a cross-sectional view explanatory of the flexibility. FIG. 7 is a cross-sectional view showing a condition before the switch is operated. FIG. 8 is a cross-sectional view showing a condition when the switch is operated.

In FIG. 5, the poly-dome switch 121 comprises a front sheet 22, a spacer sheet 23, an FPC 24, and an adhesive sheet 25. In the poly-dome switch 121 of this embodiment, a molded, transparent member is used as the front sheet 22. A design portion 26 is provided on the inner face of the front sheet 22, and the poly-dome switch 121 can reflect the design change and model change of a machine and motor or a like on which the poly-dome switch 121 is attached by replacing only the front sheet 22.

The poly-dome switch 121 of this embodiment is identical to the poly-dome switch 121 except that the design portion 26 is added. Therefore, the switch operation is the same as that of the poly-dome switch 121, and an advantageous effect, achieved by the design portion 102, is added.

The design portion 26, as well as an electrode 28 (see FIG. 6) for the FPC 24, is provided on the inner face of each projected portion 27. The electrode 28 (see FIG. 6) is provided at the apex of this inner face. The design portion 26 is printing and/or ornamentation formed on the inner face of the front sheet 22. In this embodiment, for example, the design portion 26 corresponds to characters "ON", "OFF", "UP" and "DOWN" and figures "1" to "4", printed in white color (These characters and figures are printed near to the projected portions 27, respectively.). In this embodiment, a background color, printed, for example, in black color, also corresponds to the design portion 26 (After these are printed, the electrode 28, made of carbon, is formed.).

The poly-dome switch 121 of this embodiment can achieve the switch operating functions, similar to those of the related switch, with the small construction and simple structure, and therefore the thin/lightweight design of the switch can be achieved, and also the degree of freedom for the configuration can be enhanced. And besides, the thin design is much more enhanced as compared with the related structure, and therefore the space-saving at the mounting member can be achieved, and a through opening for mounting the related switch does not need to be provided (This leads to the increased rigidity of the mounting member and also to the enhanced productivity.). Furthermore, the poly-dome switch is provided with the adhesive sheet 25, and has flexibility, and the FPC 24 has the external connector 33, and therefore the installation range can be increased as compared with the related structure, and the mounting of the switch on the mounting member can be effected easily.

As described above at the beginning of the description of this embodiment, the front sheet 22 comprises transparent member, and the design portion 26 reflecting various design change are provided on the inner face of the front sheet 22. Therefore the design change and the model change of the machine or the motor on which the poly-dome switch 121 is attached can be easily reflected by replacing only the front sheet 22 including the design portion 26.

In this embodiment, the thickness of the spacer sheet 23 can be increased to such an extent as not to adversely affect the flexibility, thereby securing the necessary stroke dimension, and by doing so, the stroke of each projected portion 27 can be increased (In other words, the required stroke of the projected portion 27 during the operation of the switch can be determined by the thickness of the spacer sheet 23.).

Figure 9:
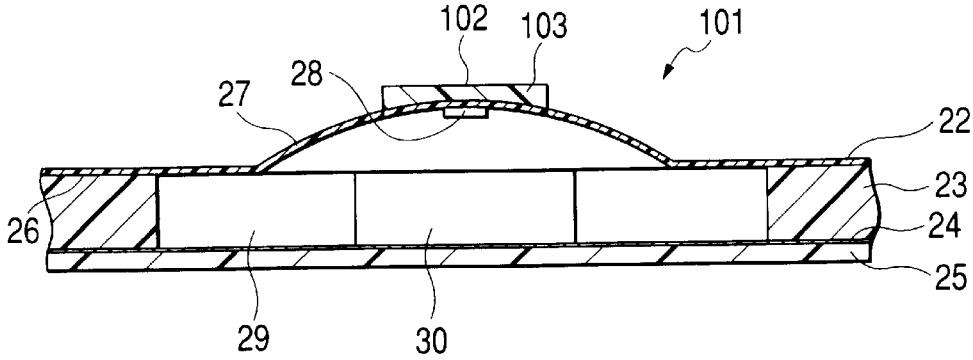
FIG. 9 is a cross-sectional view of an important portion of a second embodiment of a variation-meeting dome switch of the invention.

Next, a third embodiment of a variation-meeting dome switch of the invention will be described. FIG. 9 is a cross-sectional view showing an important portion of the third embodiment.

In FIG. 9, the poly-dome switch 101 comprises a front sheet 22, a spacer sheet 23, an FPC 24, and an adhesive sheet 25. In the poly-dome switch 101 of the present invention, a molded, transparent member is used as the front sheet 22. A design portion 26 is provided on an inner face of the front sheet 22, and a design portion 102 is provided on an outer face of the front sheet 22. The design change and the variation-meeting can be easily effected only with the front sheet 22 including the design portions 26 and 102.

The poly-dome switch 101 of this embodiment is identical to the poly-dome switch 121 except that the design portion 102 is added. Therefore, the switch operation is the same as that of the poly-dome switch 121, and an advantageous effect, achieved by the design portion 102, is added. And besides, the poly-dome switch 101 of this embodiment gives a higher-grade impression than the poly-dome switch 121 does.

The design portion 102 is a coating layer 103 of a synthetic resin formed on projected portions 27 of the front sheet 22. In this embodiment, each coating layer 103 has a suitable shape and a suitable thickness, and is formed on an apex portion of an outer face of the corresponding projected portion 27. The design portion 102 (the coating layer 103) is provided to impart a variation to the touch of the projected portion 27, and the variation-meeting range is further increased.

Figure 10:
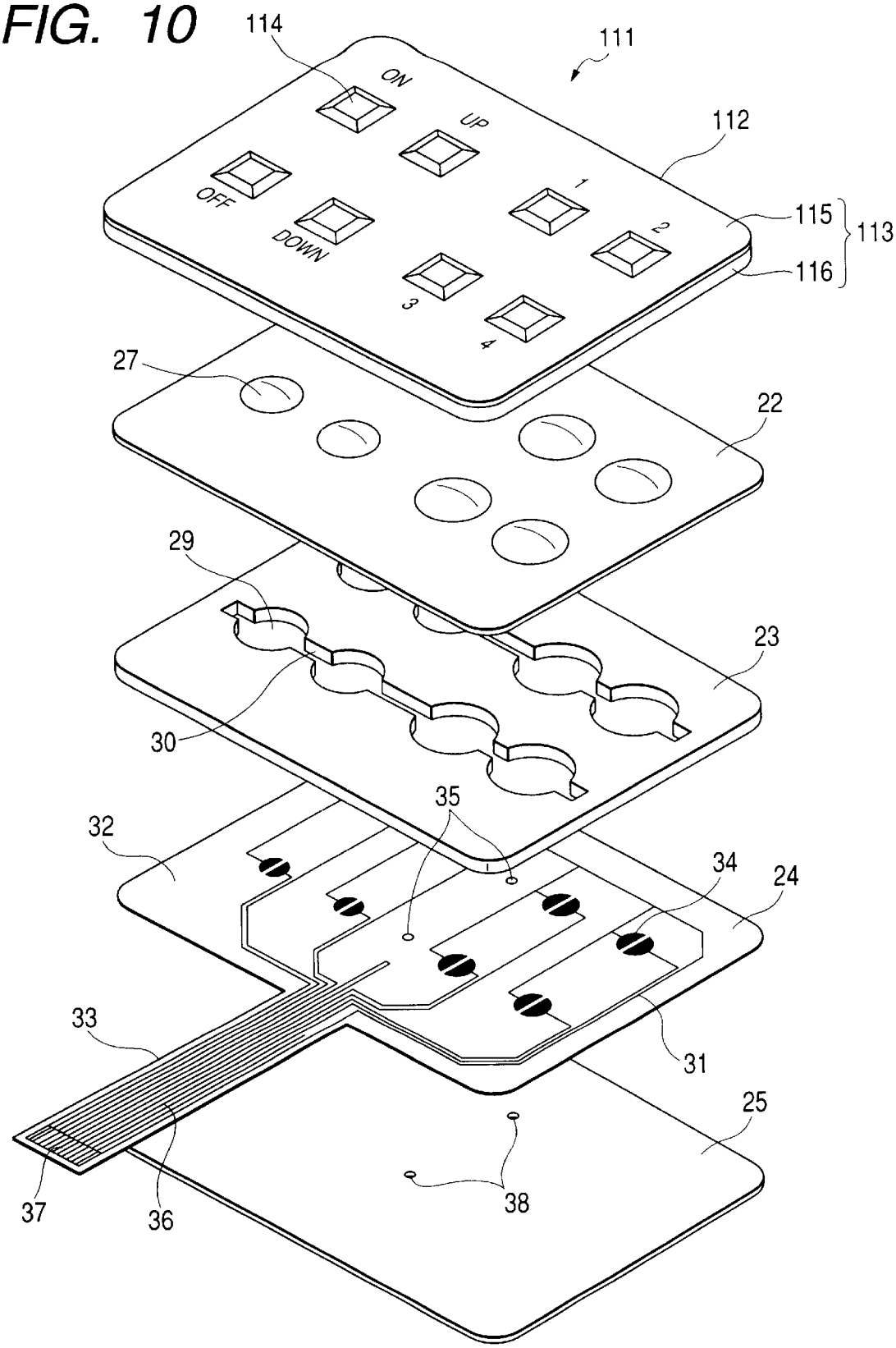
FIG. 10 is an exploded perspective view of a third embodiment of a variation-meeting dome switch of the invention.

Next, a fourth embodiment of a variation-meeting dome-switch of the invention will be described. FIG. 10 is an exploded perspective view of the fourth embodiment, and FIG. 11 is a cross-sectional view of an important portion of FIG. 10.

Figure 11:
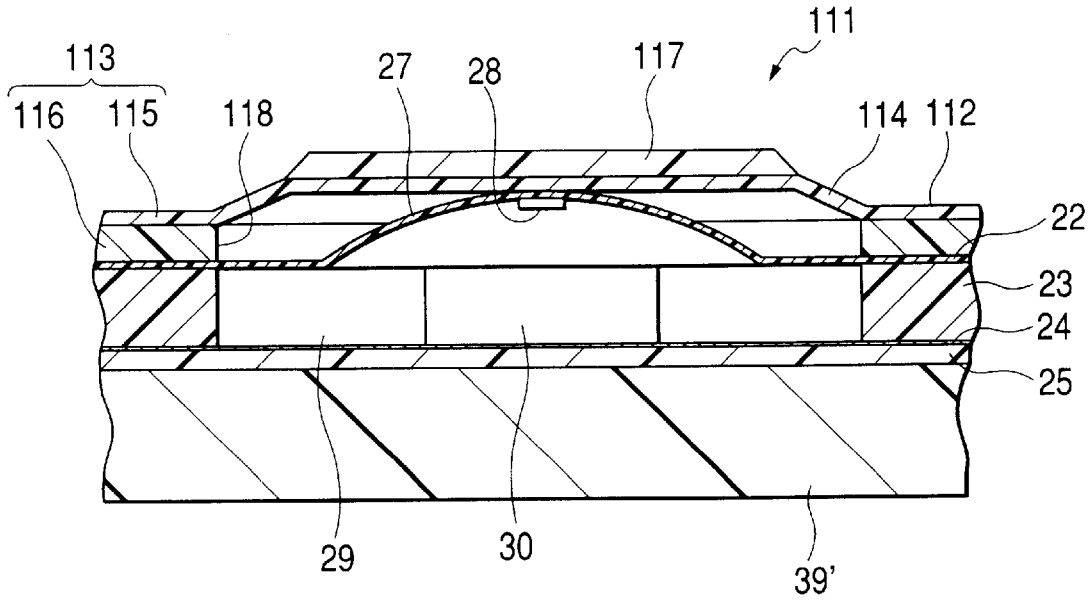
FIG. 11 is a cross-sectional view showing an important portion in FIG. 10.
Figure 12:
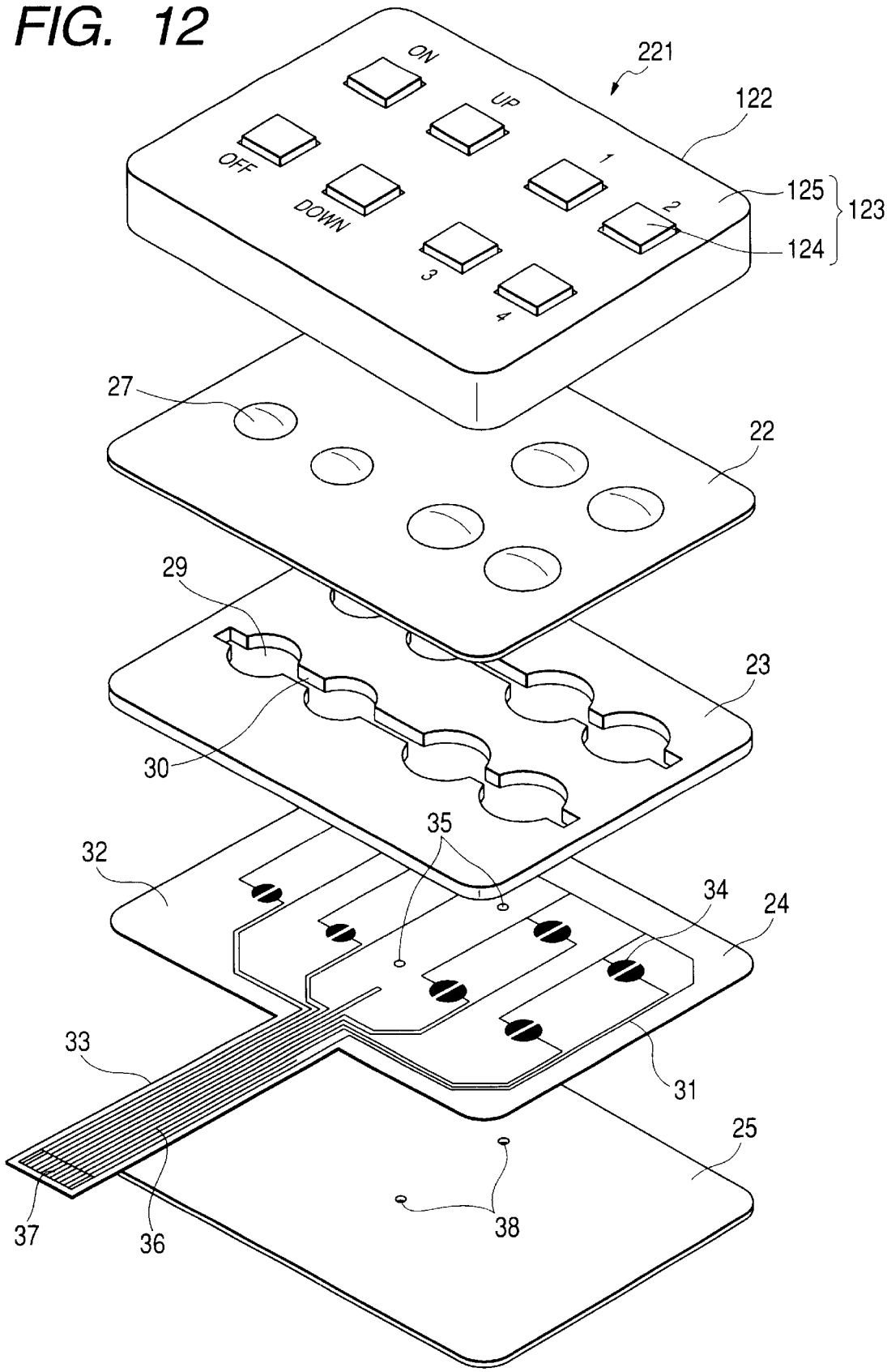
FIG. 12 is an exploded perspective view of a fourth embodiment of a variation-meeting dome switch of the invention.

In FIGS. 11 and 12, the poly-dome switch 111 comprises a front sheet 22, a spacer sheet 23, an FPC 24, and an adhesive sheet 25. In the poly-dome switch 111 of the invention, a molded, transparent member is used as the front sheet 22. A design portion 112 is formed on an outer face of the front sheet 22, and the design change and the variation-meeting can be easily effected only with the front sheet 22 including the design portion 112.

The poly-dome switch 111 of this embodiment differs from the poly-dome switch 121 in that the design portion 26 is replaced by the design portion 112. The poly-dome switch 111 of this embodiment gives a higher-grade impression than the poly-dome switch 121 does.

The design portion 112 is a sheet-like cover member 113, covering the outer face of the front sheet 22, and comprises a design portion-purpose front sheet 115, and a design portion-purpose spacer sheet 116 interposed between the design portion-purpose front sheet 115 and the front sheet 22, the design portion-purpose front sheet 115 having a plurality of depressing portions 114 which are formed integrally therewith, and are contacted respectively with projected portions 27 so as to depress these projected portions 27, respectively.

The design portion-purpose front sheet 115 is a transparent sheet member made of a synthetic resin such for example as polyethylene terephthalate (PET), and has the plurality of rectangular dome-like depressing portions 114 formed by hot pressing (in which a pressure is applied from the inner side toward the outer side) applied to the sheet member (Each depressing portion 114 may be formed into a real dome-shape having a diameter larger than the outer diameter of the projected portion 27.). The design portion-purpose front sheet 15 is molded such that it has flexibility.

In this embodiment, for example, characters "ON", "OFF", "UP" and "DOWN" and figures "1" to "4" are printed in white color on the inner face of the design portion-purpose front sheet 115 (These characters and figures are printed near to the depressing portions, respectively.). A background color, for example, of black color is also printed on this inner face.

Each of the depressing portions 114 is projected outwardly, and can be inverted inwardly. A coating layer 117 for imparting a variation to the touch of the depressing portion 114 is formed on the outer face of each depressing portion 114. The formation of the coating layers 117 is arbitrary.

The design portion-purpose spacer sheet 116 is a flexile sheet member made of a synthetic resin such for example as polyethylene terephthalate (PET), and functions to prevent the deformation of the design portion-purpose front sheet 115. The design portion-purpose spacer sheet 116 has adhesive layers (not shown) formed respectively on the obverse and reverse faces thereof, and the design portion-purpose front sheet 115 and the front sheet 22 can be fixed to these obverse and reverse faces, respectively.

The design portion-purpose spacer sheet 116 has a plurality of through holes 118 each for passing the inverted depressing portion 114 therethrough. These through holes 118 are so formed as to be disposed at a position corresponding to the projected portions 27, respectively, and at the time of the assemblage, the projected portions 27 are inserted into these through holes, respectively.

In the above construction, the poly-dome switch 111 is assembled in the following manner. First, the front sheet 22 is adhesively bonded to the obverse face of the spacer sheet 23, and the FPC 24 is adhesively bonded to the reverse face of the spacer sheet 23. Then, this laminate is affixed to the adhesive sheet 25, with the FPC 24 adhesively bonded to a circuit member-mounting face of the adhesive sheet 25. Then, the design portion 112 is adhesively fixed to the obverse face of the front sheet 22, thereby assembling the poly-dome switch.

The thus assembled poly-dome switch 111 has flexibility as described above, and therefore can be mounted not only on a mounting member 39' (see FIG. 11) with a flat face but also on a curved face of a mounting member 39.

In the case where the poly-dome switch 111 is mounted on the mounting member 39', the operation of this poly-dome switch is as follows (The drawing for the operation is omitted.).

When the switch is operated, so that the projected portion 27 is depressed through the depressing portion 114 (A load is applied downwardly in FIG. 11), the projected portion 27 resists the load, acting in the downward direction, and then is buckled to be inverted when this load exceeds a certain value (At this time, a click feeling is obtained). When the projected portion 27 is buckled and inverted, the load, acting in the downward direction, decreases, so that the depressing of the projected portion 27 proceeds smoothly. The inverted projected portion 27 passes through a through hole 29 in the spacer sheet 23, and an electrode 28, formed on the projected portion 27, is brought into contact with a contact 34 (see FIG. 10) on the FPC 24 through the through hole 29.

As a result, circuits 31 (see FIG. 10) are rendered conductive, and the poly-dome switch 111 is turned on. On the other hand, when the application of the load in the downward direction is canceled, the projected portion 27 and the depressing portion 114 are restored into their respective original shapes. As a result, the conductive condition is canceled, so that the poly-dome switch 111 is turned off.

As described above, in the poly-dome switch 111 of this embodiment, the front sheet 22 comprises the molded, transparent member, and the design portion 112, meeting variations, is provided on the outer face of the front sheet 22, and therefore the design change and the variation-meeting can be easily effected only with the front sheet 22 including the design portion 112.

The poly-dome switch 111 of this embodiment can achieve the switch operating functions, similar to those of the related switch, with the small construction and simple structure. With this small construction and simple structure, the thin/lightweight design of the switch can be achieved, and also the degree of freedom for the configuration can be enhanced. And besides, the thin design is much more enhanced as compared with the related structure, and therefore the space-saving at the mounting member can be achieved, and a through opening for mounting purposes does not need to be provided (This leads to the increased rigidity of the mounting member and also to the enhanced productivity.). Furthermore, the poly-dome switch is provided with the adhesive sheet 25, and has flexibility, and the FPC 24 has the external connector 33, and therefore the installation range can be increased as compared with the related structure, and the mounting of the switch on the mounting member can be effected easily.

Next, a fifth embodiment of a variation-meeting dome-switch of the invention will be described. FIG. 12 is an exploded perspective view of the fifth embodiment, and FIG. 13 is a cross-sectional view of an important portion of FIG. 12.

Figure 13:
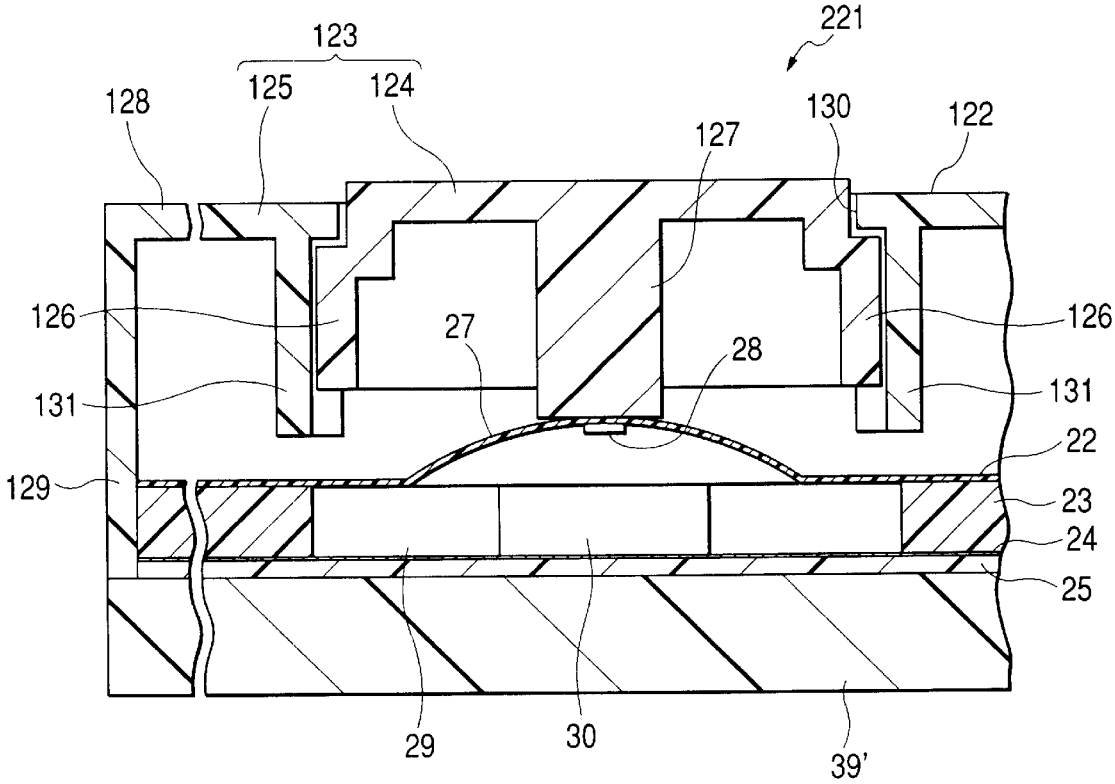
FIG. 13 is a cross-sectional view showing an important portion in FIG. 12.

In FIGS. 12 and 13, the poly-dome switch 221 comprises a front sheet 22, a spacer sheet 23, an FPC 24, and an adhesive sheet 25. In the poly-dome switch 221 of the invention, a molded, transparent member is used as the front sheet 22. A design portion 122 is formed on an outer face of the front sheet 22, and the design change and the variation-meeting can be easily effected only with the front sheet 22 including the design portion 122.

The poly-dome switch 221 of this embodiment differs from the poly-dome switch 121 in that the design portion 26 is replaced by the design portion 122. The poly-dome switch 221 of this embodiment gives a higher-grade impression than the poly-dome switch 121 does.

The design portion 122 is a sheet-like cover member 123, covering the outer face of the front sheet 22, and comprises a plurality of key tops 124 of a synthetic resin, which are contacted respectively with projected portions 27 so as to depress these projected portions 27, respectively, and a cover member body 125 of a synthetic resin holding the key tops 124 in such a manner that the key tops 124 can be depressed.

Each key top 124 has a side wall serving as a sliding portion 126 for the cover member body 125. A bar-like or convex depressing portion 127, disposed in contact with the projected portion 27, is formed within the key top 124 at a central portion thereof. The molded key tops 124 have a suitable color.

The cover member body 125 includes an upper wall 128, and a frame-like side wall 129. The molded cover member body 125 has a suitable color. Openings 130 for the key tops 124 are formed through the upper wall 128, and also guide portions 131 for the key tops 124 are formed on the upper wall 128. For example, characters "ON", "OFF", "UP" and "DOWN" and figures "1" to "4" are printed in a suitable color on the upper wall 128 (These characters and figures are printed on the outer face of the upper wall, and are disposed near to peripheral edges of the openings 130, respectively.). The guide portions 131 are formed on the inner face of the upper wall, and are disposed in surrounding relation to the peripheral edges of the openings 130, respectively, and each guide portion 131 guides the sliding movement of the sliding portion 126 of the corresponding key top 124.

In the above construction, the poly-dome switch 221 is assembled in the following manner. First, the front sheet 22 is adhesively bonded to the obverse face of the spacer sheet 23, and the FPC 24 is adhesively bonded to the reverse face of the spacer sheet 23. Then, this laminate is affixed to the adhesive sheet 25, with the FPC 24 adhesively bonded to a circuit member-mounting face of the adhesive sheet 25. Then, this laminate is mounted on a mounting member 39', and thereafter the design portion 112 is fixed to the mounting member in covering relation the obverse face of the front sheet 22, thus assembling the poly-dome switch.

By forming the free end of the side wall 129, for example, into a curved shape, the poly-dome switch 221 can be mounted on a curved face of a mounting member.

In the case where the poly-dome switch 221 is mounted on the mounting member 39', the operation of this poly-dome switch is as follows (The drawing for the operation is omitted.).

When the switch is operated, so that the projected portion 27 is depressed through the key top 124 (A load is applied downwardly in FIG. 13), the projected portion 27 resists the load, acting in the downward direction, and then is buckled to be inverted when this load exceeds a certain value (At this time, a click feeling is obtained). When the projected portion 27 is buckled and inverted, the load, acting in the downward direction, decreases, so that the depressing of the projected portion 27 proceeds smoothly. The inverted projected portion 27 passes through a through hole 29 in the spacer sheet 23, and an electrode 28, formed on the projected portion 27, is brought into contact with a contact 34 (see FIG. 12) on the FPC 24 through the through hole 29.

As a result, circuits 31 (see FIG. 12) are rendered conductive, and the poly-dome switch 221 is turned on. On the other hand, when the application of the load in the downward direction is canceled, the projected portion 27 is restored into its original shape. As a result, the conductive condition is canceled, so that the poly-dome switch 221 is turned off.

As described above, in the poly-dome switch 221 of this embodiment, the front sheet 22 comprises the molded, transparent member, and the design portion 122, meeting variations, is provided on the outer face of the front sheet 22, and therefore the design change and the variation-meeting can be easily effected only with the front sheet 22 including the design portion 122.

The poly-dome switch 221 of this embodiment can achieve the switch operating functions, similar to those of the related switch, with the small construction and simple structure. With this small construction and simple structure, the thin/lightweight design of the switch can be slightly improved as compared with the related structure, and also the degree of freedom for the configuration can be enhanced. And besides, the thin design is more enhanced as compared with the related structure, and therefore the space-saving at the mounting member can be achieved, and a through opening for mounting purposes does not need to be provided (This leads to the increased rigidity of the mounting member and also to the enhanced productivity.). Furthermore, the poly-dome switch is provided with the adhesive sheet 25, and has flexibility, and the FPC 24 has the external connector 33, and therefore the installation range can be increased as compared with the related structure, and the mounting of the switch on the mounting member can be effected easily.

Figure 14:
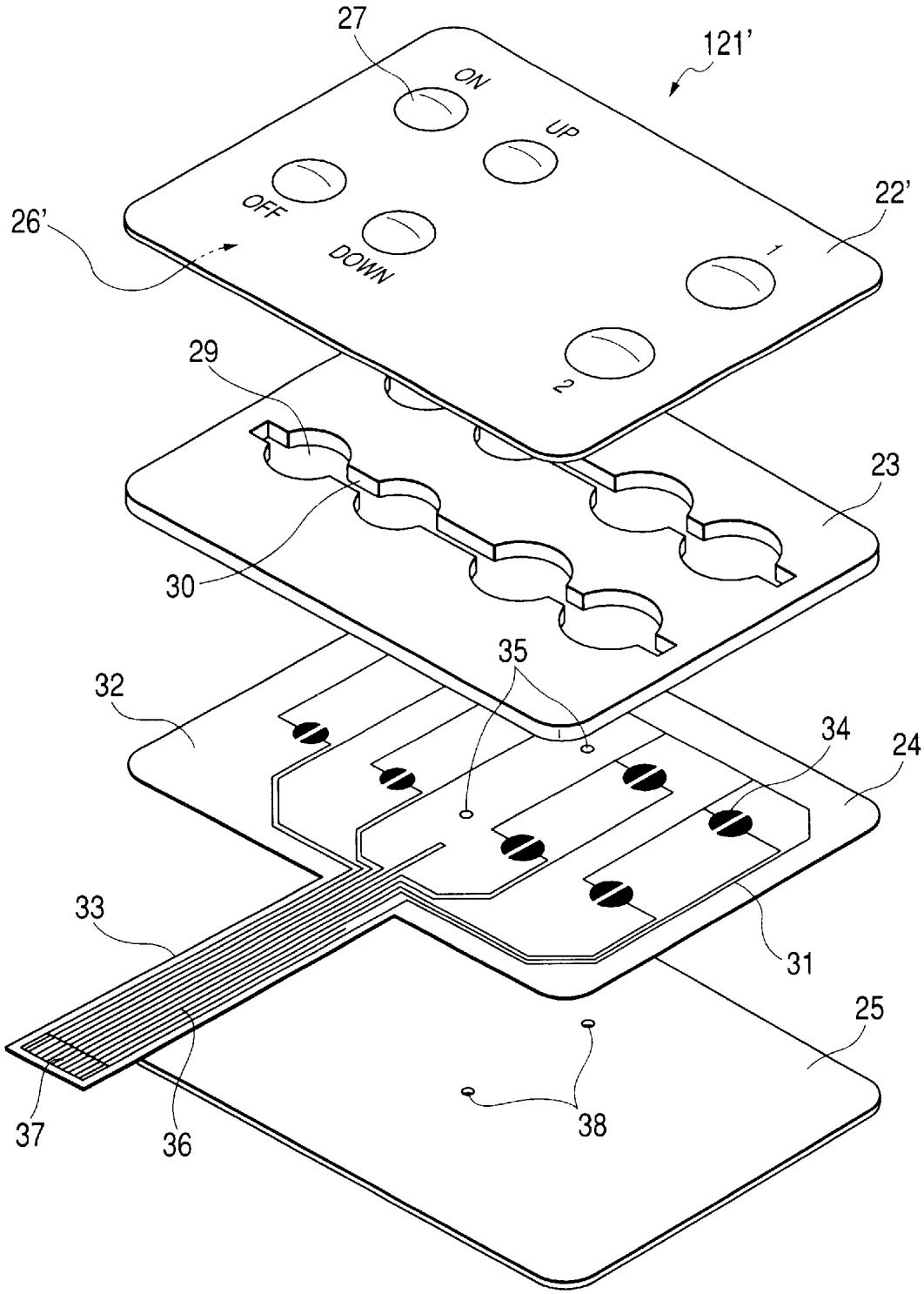
FIG. 14 is an exploded perspective view of a fifth embodiment of a variation-meeting dome switch of the invention.

Next, a sixth embodiment of a variation-meeting dome switch of the invention will be described. FIG. 14 is an exploded perspective view of the sixth embodiment, and FIG. 15 is a cross-sectional view of an important portion of FIG. 15.

Figure 15:
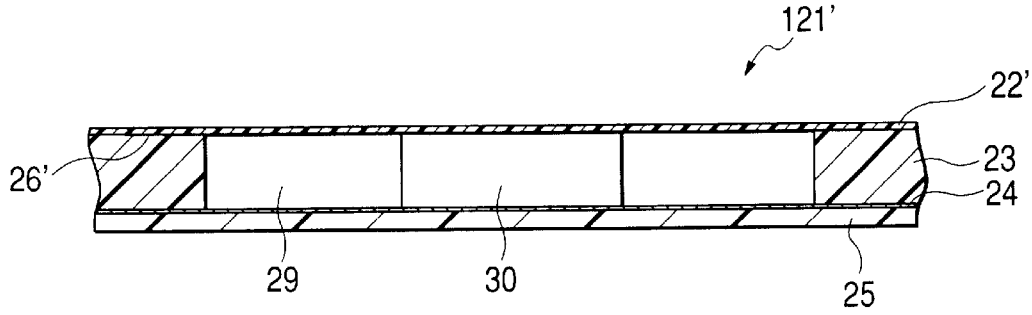
FIG. 15 is a cross-sectional view showing an important portion in FIG. 14.

In FIGS. 14 and 15, the poly-done switch 121' comprises a front sheet 22', a spacer sheet 23, an FPC 24, and an adhesive sheet 25. In the poly-dome switch 121' of the invention, a molded, transparent member is used as the front sheet 22'. In the poly-dome switch 121' of the invention, projected portions 27, a required number of projected portions 27, corresponding to a variation, are formed on the front sheet 22'. A design portion 26' is formed on an inner face of the front, sheet 22', and the design change and the variation-meeting can be easily effected only with the front sheet 22' including the design portion 26'.

The poly-dome switch 121' of this embodiment differs from the poly-dome switch 121 in that the number of the projected portions 26 is smaller. The printing of characters and figures is changed in accordance with the number of the projected portions 27. Therefore, the switch operation is the same as that of the poly-dome switch 121. The poly-dome switch 121' of this embodiment can achieve advantageous effects achieved by the poly-dome switch 121.

In accordance with the variation, the projected portions 27 are formed respectively on selected ones of those portions of the front sheet 22' disposed at a position corresponding to through holes 29 in the spacer sheet 23. In other words, the projected portions 27 are formed on some of these portions of the front sheet while the projected portions 27 are not formed on the rest of these portions. Here, the through holes 29 and contacts 34, provided at regions where the projected portions 27 are not formed, are dummy (see FIG. 15).

As described above, the poly-dome switch 121' of this embodiment has the front sheet 22', and therefore the variation-meeting range can be increased. And besides, when this construction is applied to the above embodiments, the variation-meeting range can be further increased.

In the above embodiments, the spacer sheet 23, the FPC (circuit member) 24 and the adhesive sheet 25 can be used as the common parts regardless of the variations. The front sheets 22 and 22' are the variation-meeting parts.

Next, modified examples of the poly-dome switch 21 (selected as a representative example among the above embodiments), as well as various installation examples, will be described. The modified examples and the various installation examples will be described with reference to FIGS. 5 to 18 sequentially.

Figure 16:
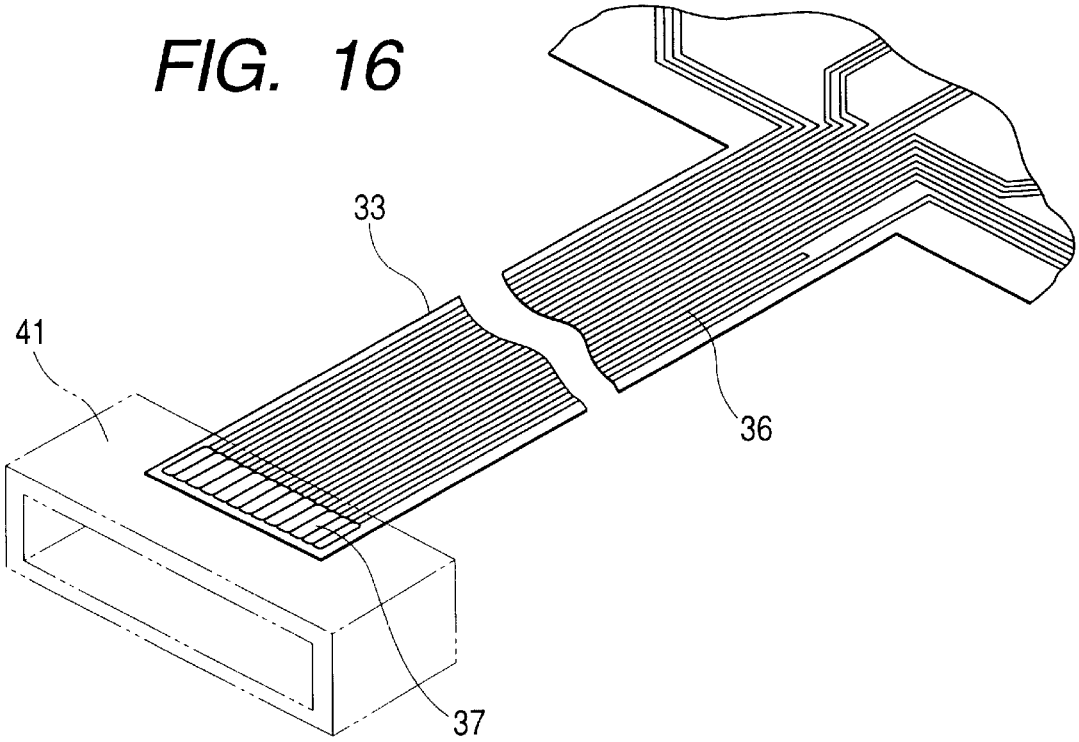
FIG. 16 is a perspective view explanatory of another example of external connector.

FIG. 16 is a perspective view explanatory of another example of the external connector 33. The plurality of edge connector terminals 37 are provided at the external connector 33. However, instead of using the plurality of edge connector terminals 37, a connector 41, indicated in imaginary lines in FIG. 16, may be provided at the distal end portion of the wire connection circuit portion 36. Thus, the construction of the external connector 33 can be suitably changed in accordance with the form of the mating connecting member.

Figure 17:
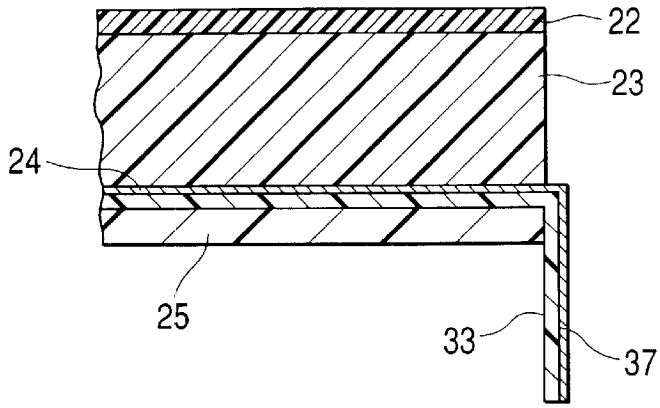
FIG. 17 is a cross-sectional view explanatory of a further example of external connector.

FIG. 17 is a cross-sectional view explanatory of a further example of the external connector 33. Although the wire connection circuit portion 36 of a suitable length is provided at the external connector 33, this external connector 33 may be modified to have only a plurality of edge connector terminals 37, as shown in FIG. 17. The edge connector terminals 37 can be bent at right angles relative to the circuit member body 32, or can be bent to be laid flat against the adhesive fixing face of the adhesive sheet 25. Thus, the construction of the external connector 33 can be suitably changed in accordance with the form of the mating connecting member.

Figure 18:
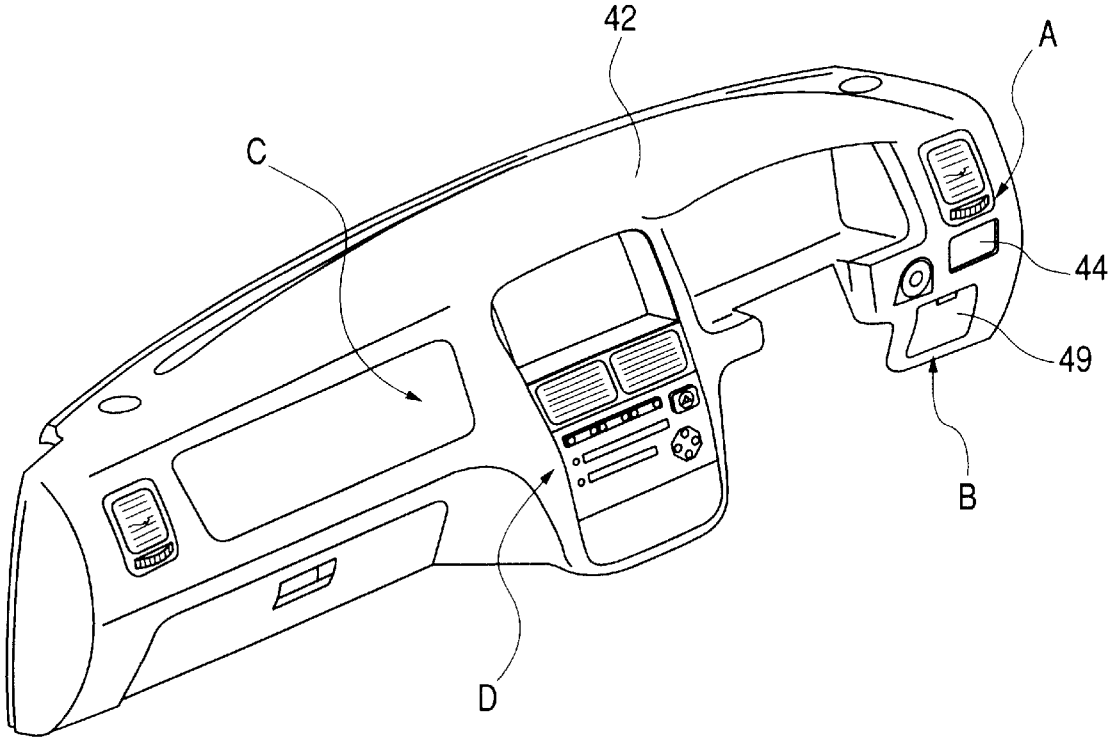
FIG. 18 is a perspective view of an instrument panel of an automobile, showing a first installation example for a dome switch.

FIG. 18 is a perspective view of an instrument panel of an automobile, showing a first installation example. The poly-dome switch 21 can be mounted (or installed), for example, at any of portions (positions) of the instrument panel 42 (serving as a mounting member) indicated respectively by arrows A to D (This will be described in a little more detail with reference to FIGS. 19 to 24. The mounting portion is not limited to the instrument panel 42, but the switch can naturally be mounted on a door panel, a roof panel or others. And besides, the switch can be mounted on any other suitable portion or member according to the need of the user in so far as it can be bonded thereto.).

Figure 19:
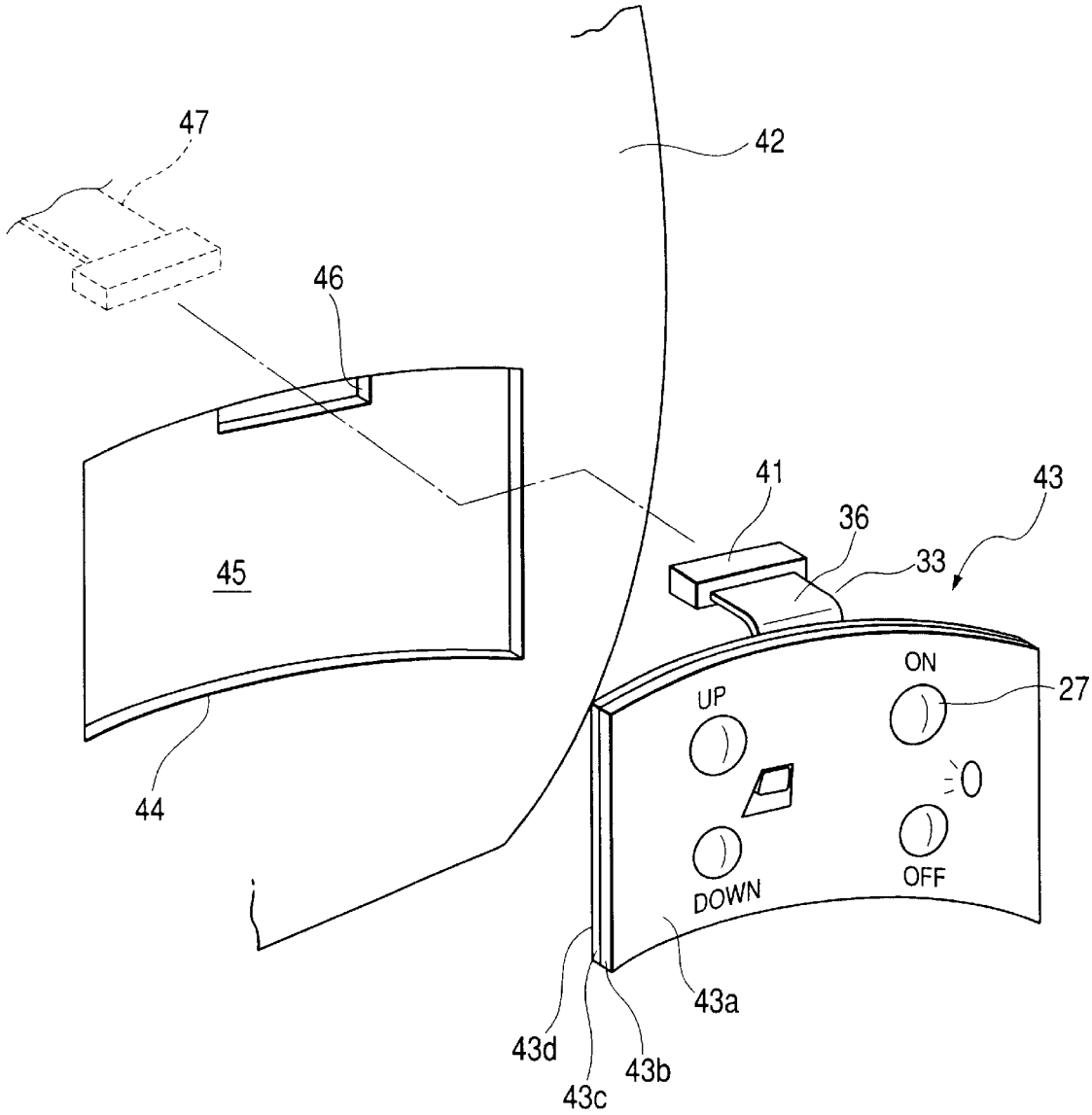
FIG. 19 is a perspective view explanatory of an example in which the switch is mounted in a recess portion in the instrument panel.

In FIG. 19, reference numeral 43 denotes a poly-dome switch which is changed in appearance configuration, design and so on with respect to the poly-dome switch 21 (This poly-dome switch is basically similar to the poly-dome switch 21.). Reference numeral 44 denotes a recess portion formed, for example, at the position of arrow A in FIG. 18.

The poly-dome switch 43 comprises a front sheet 43*a*, a spacer sheet 43*b*, an FPC (circuit member) 43*c*, and an adhesive sheet 43*d*. The poly-dome switch 43 is designed to have flexibility. A plurality of projected portions 27 are formed on the front sheet 43*a*. Electrodes (not shown), as well as characters (as illustrated), signs or the like, are printed on an inner face of the front sheet 43*a*. Through holes (not shown), corresponding respectively to the projected portions 27, and air escape portions (not show) are formed through the spacer sheet 43*b*. External connection member 33, having a wire connection circuit portion 36 and a connector 41, is provided at the FPC 43*c*.

The recess portion 44 has a curved face 45 conforming to the front face of the instrument panel 42. A small through hole 46 for the connection of the external connector 33 thereto is formed in the curved face 45.

In the above construction, the poly-dome switch 43 can be mounted relative to the recess portion 44 in the following manner. Namely, the poly-dome switch 43 is curved in accord with a curved condition of the curved face 45, and is bonded to the recess portion 44 through the adhesive sheet 43*d*, and by doing so, the poly-dome switch 43 can be easily mounted at the recess portion 44. At this time, the connector 41 of the external connector 33 is connected to a connector of a wire harness 47, provided inside the instrument panel 42, through the through hole 46.

Figure 20:
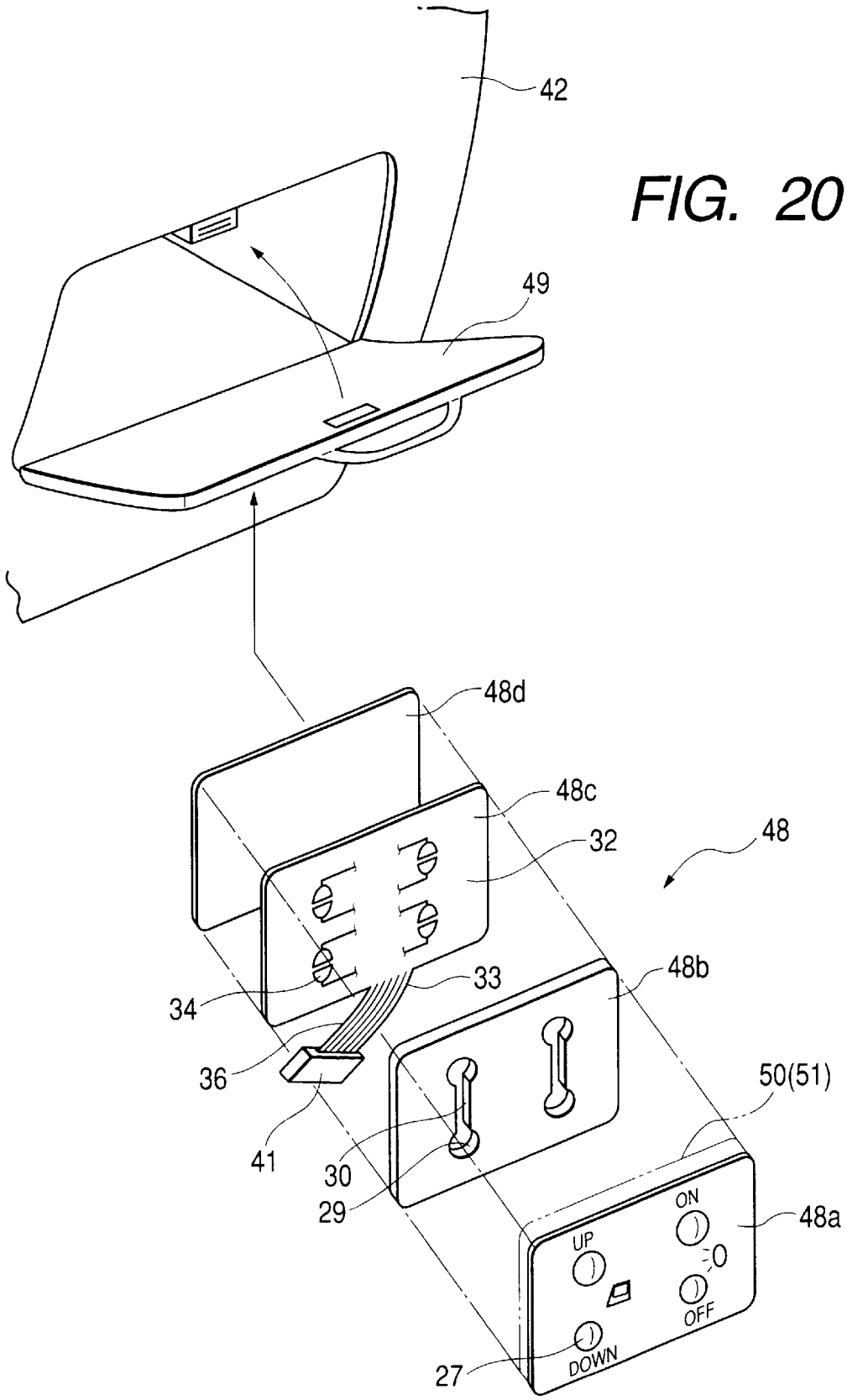
FIG. 20 is an exploded perspective view explanatory of an example in which the switch is mounted on an opening/closing member on the instrument panel.

In FIG. 20, reference numeral 48 denotes a poly-dome switch which is changed in appearance configuration, design and so on with respect to the poly-dome switch 21 (This poly-dome switch is basically similar to the poly-dome switches 21 and 43.). Reference numeral 49 denotes an opening-closing member of the instrument panel 42 provided, for example, at the position of arrow B in FIG. 18.

Figure 21A:
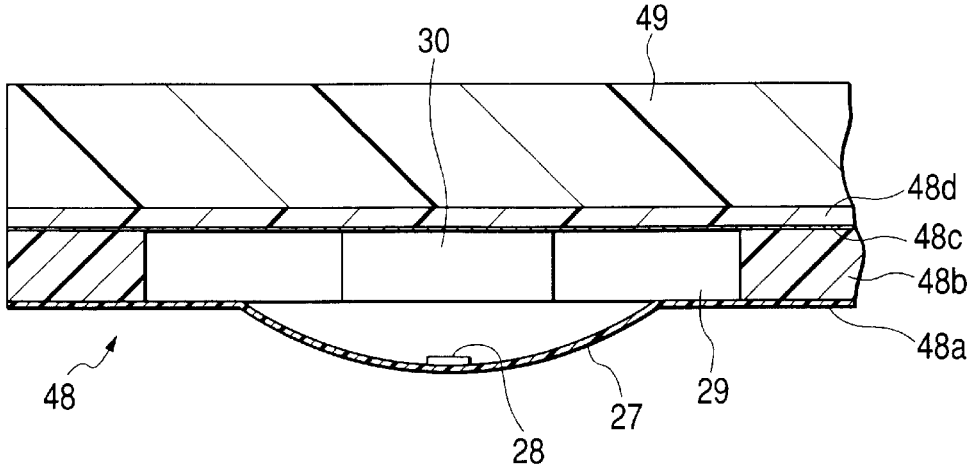
FIG. 21A is a cross-sectional view showing a front sheet of the example of FIG. 20.

The poly-dome switch 48 comprises a front sheet 48*a*, a spacer sheet 48*b*, an FPC (circuit member) 48*c*, and an adhesive sheet 48*d*, as shown in FIGS. 20 and 21A. The poly-dome switch 48 is designed to have flexibility. A plurality of projected portions 27 are formed on the front sheet 48*a*. Electrodes (not shown), as well as characters (as illustrated), signs or the like, are printed on an inner face of the front sheet 48*a*. Through holes 29, corresponding respectively to the projected portions 27, and air escape portions 30 are formed through the spacer sheet 48*b*. The FPC 48*c* comprises a circuit member body 32, having contacts 34, and external connector 33, having a wire connection circuit portion 36 and a connector 41.

In the above construction, the poly-dome switch 48 can be mounted relative to the opening-closing member 49 in the following manner. Namely, the poly-dome switch 48 is curved in accord with the face configuration of the opening-closing member 49 (This poly-dome switch remains as it is if this face configuration is flat), and is bonded to the face of the opening-closing member 49 through the adhesive sheet 48*d*, and by doing so, the poly-dome switch 48 can be easily mounted on the opening-losing member 49. At this time, the connector 41 of the external connector 33 is connected to a connector of a wire harness (not shown), provided inside the instrument panel 42, through a through hole (not shown).

The poly-dome switch 48 is thus mounted on the opening-closing member 49, and with this arrangement, small articles can be stored when opening the opening-closing member 49, and the switch can be operated when the opening-closing member 49 is disposed in a closed condition. Therefore, the space-saving is effective.

Figure 21B:
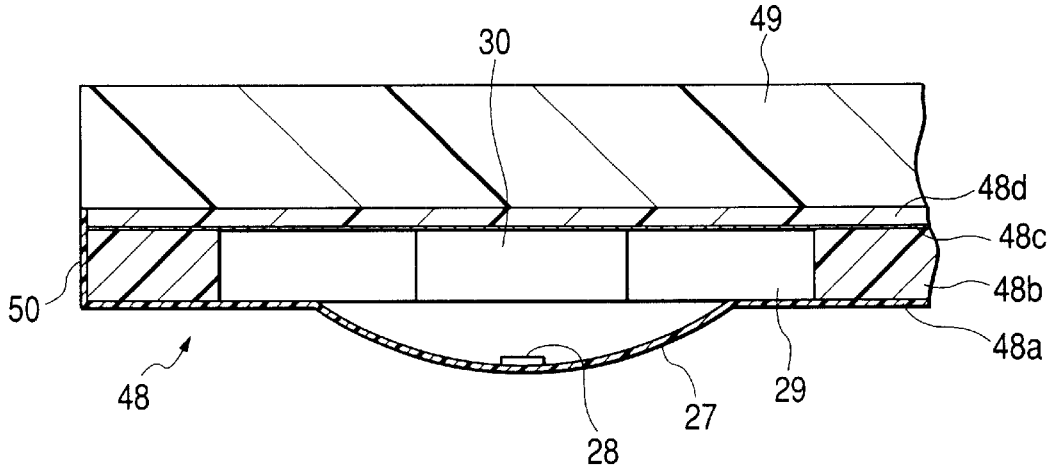
FIG. 21B is a cross-sectional view showing another example of the front sheet.
Figure 21C:
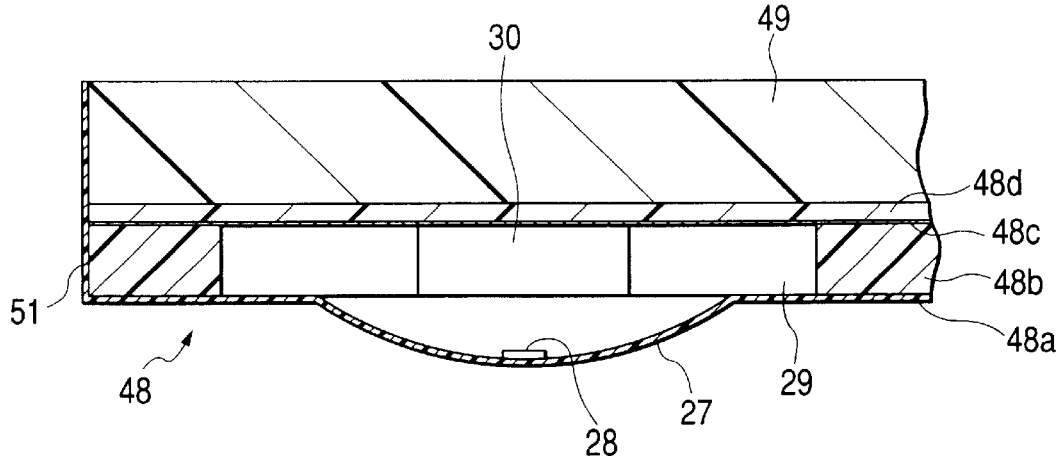
FIG. 21C is a cross-sectional view of a further example of the front sheet.

The front sheet 48*a* may be modified as follows. As shown in FIG. 21B, a frame portion 50 may be provided to cover side edges of the spacer sheet 48*b*, FPC 48*c* and adhesive sheet 48*d*. As shown in FIG. 21C, a frame portion 51 may be provided to cover not only the side edges of the spacer sheet 48*b*, FPC 48*c* and adhesive sheet 48*d* but also a side edge of the opening-closing member 49. The rigidity of each of the frame portions 50 and 51 can be increased to such an extent as not to adversely affect the flexibility (A separate frame can be insert molded in an edge portion of the front sheet 48*a*.). The frame portion 50, 51 has an advantage that the opening-closing member 49 in its opened condition looks better.

Figure 22:
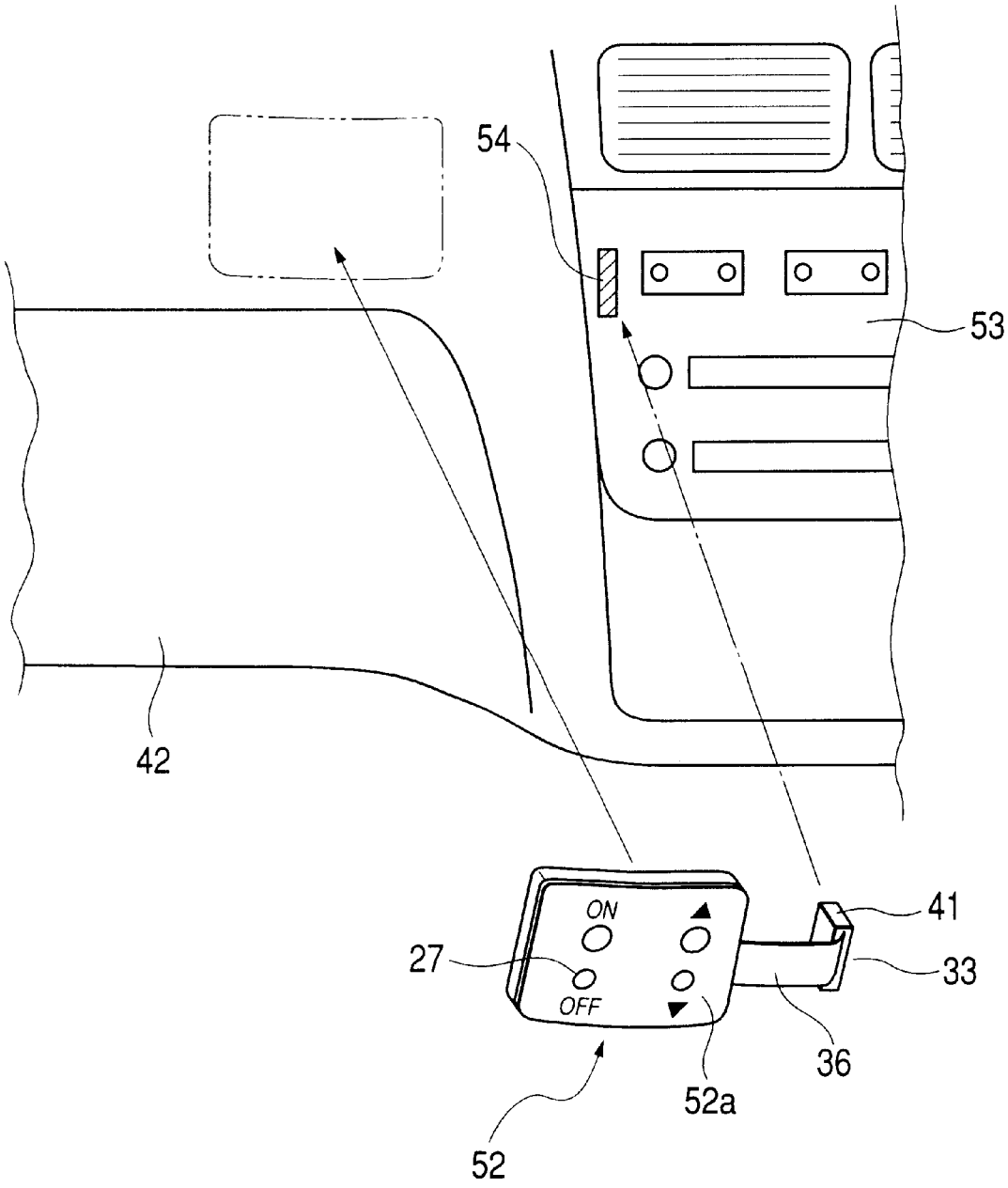
FIG. 22 is a perspective view explanatory of an example in which a dome switch, serving as an option switch for an auxiliary equipment, such as an audio equipment, is mounted on the face of the instrument panel.

In FIG. 22, reference numeral 52 denotes a poly-dome switch which is changed in appearance configuration, design and so on with respect to the poly-dome switch 21 (This poly-dome switch is basically similar to the poly-dome switches 21, 43 and 48.). Reference numeral 53 denotes an auxiliary equipment (accessory) such as an audio equipment. The poly-dome switch 52 is mounted, for example, at the position of arrow C in FIG. 18, and functions as an optional switch for the auxiliary equipment 53.

The poly-dome switch 52 comprises a front sheet 52*a*, a spacer sheet, an FPC (circuit member), and an adhesive sheet. The poly-dome switch 52 is designed to have flexibility. A plurality of projected portions 27 are formed on the front sheet 52*a*. Electrodes (not shown), as well as characters (as illustrated), signs or the like, are printed on an inner face of the front sheet 52*a*. External connection member 33, having a wire connection circuit portion 36 and a connector 41, is provided at the FPC.

In the above construction, the poly-dome switch 52 can be mounted within the range of the length of the wire connection circuit portion 36 as follows. Namely, the connector 41, provided at the external connector member 33, is connected to a connection portion 54 of the auxiliary equipment 53, and thereafter the poly-dome switch 52 is curved in accord with the face configuration of the instrument panel 42 (This poly-dome switch remains as it is if this face configuration is flat), and is bonded through the adhesive sheet to the face of the instrument panel 42 at such a position that the switch can be easily operated. By doing so, the poly-dome switch 52 can be easily mounted.

Figure 23:
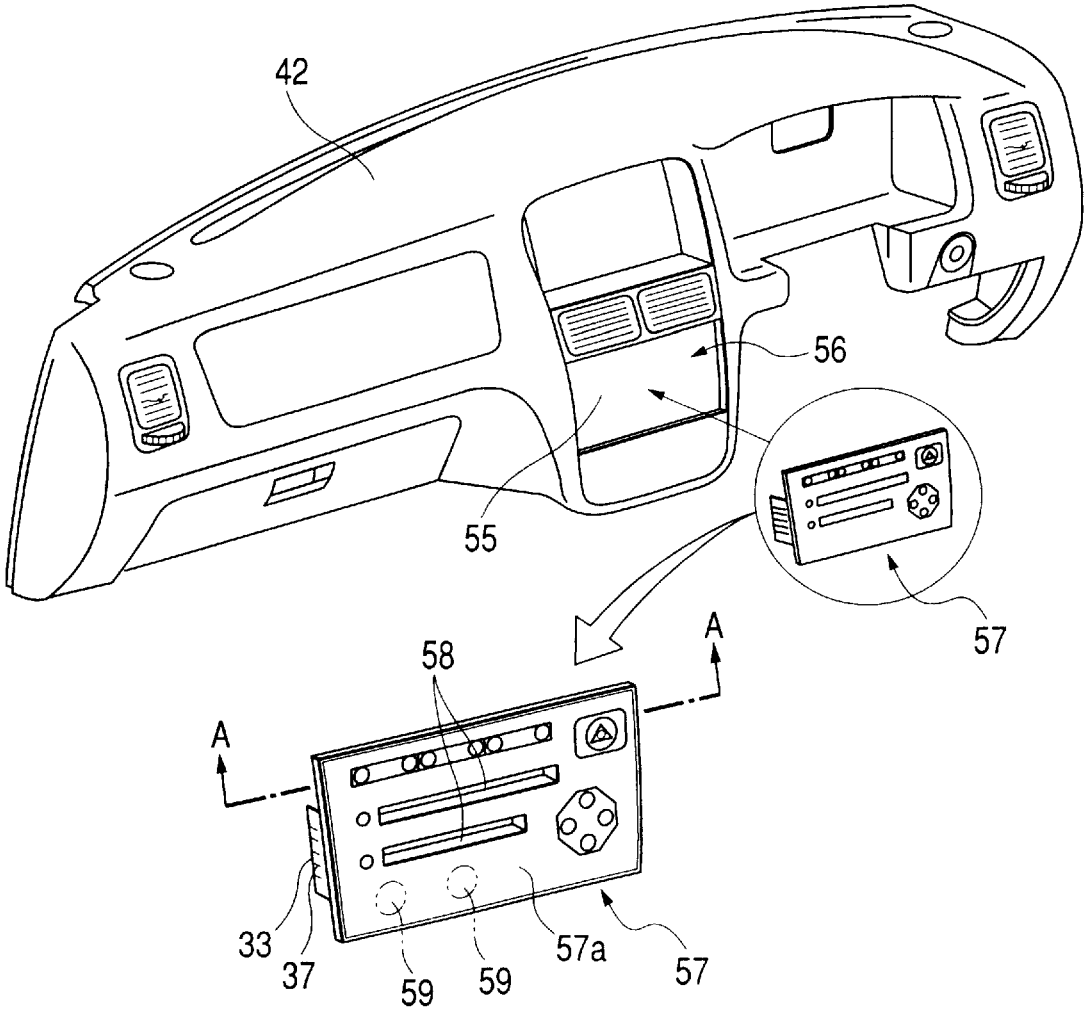
FIG. 23 is a perspective view explanatory of an example in which a dome switch is mounted on an auxiliary equipment, such as an audio equipment, mounted on the instrument panel.
Figure 24:
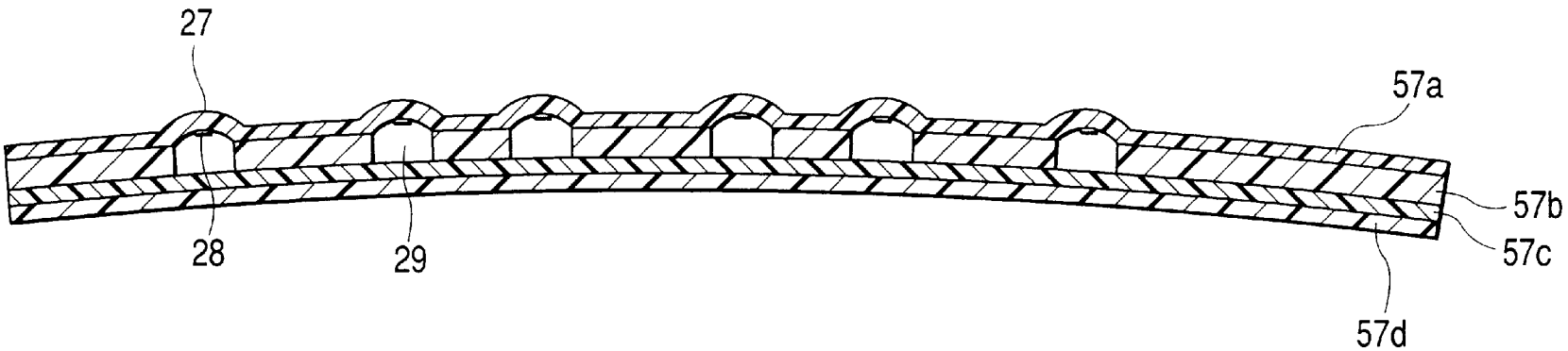
FIG. 24 is a cross-sectional view taken along the line A—A of FIG. 23.

In FIGS. 23 and 24, reference numeral 55 denotes an auxiliary equipment body of an auxiliary equipment 56, such as an audio equipment, mounted at the position of arrow D in FIG. 18. Reference numeral 57 denotes a poly-dome switch mounted on a front face of the auxiliary equipment body 55, and this poly-dome switch serves as a switch operating portion of the auxiliary equipment 56.

The poly-dome switch 57 comprises a front sheet 57*a*, serving also as a bezel, a spacer sheet 57*b*, an FPC (circuit member) 57*c*, and an adhesive sheet 57*d*. The poly-dome switch 57 is designed to have flexibility. A plurality of projected portions 27 are formed on the front sheet 57*a*. Electrodes 28, as well as designs or the like, are printed on an inner face of the front sheet 57*a*. Through holes 29, corresponding respectively to the projected portions 27, and air escape portions (not shown) are formed through the spacer sheet 57*b*. External connection member 33, comprising edge connector terminals 37, is provided at the FPC 57*c*.

Reference numeral 58 denotes insertion slots for a CD, a MD and the like (Similar insertion slots are formed in the auxiliary equipment body 55.). If it is necessary to provide dial switches, through holes may be formed respectively at positions designated at 59. The above-mentioned frame portion 50 (see FIG. 21) may be provided at the edge portion of the front sheet 57*a*.

In the above construction, the poly-dome switch 57 is bonded to the front face of the auxiliary equipment body 55 through the adhesive sheet 57*d*, and by doing so, the poly-dome switch can be easily mounted. At this time, the edge connector terminals 37 of the external connector 33 are connected to a connection portion (not shown) of the auxiliary equipment body 55.

This poly-dome switch 57 has an advantage that the switch operating portion of the auxiliary equipment 56 can be suitably changed according to the need of the user.

Figure 25:
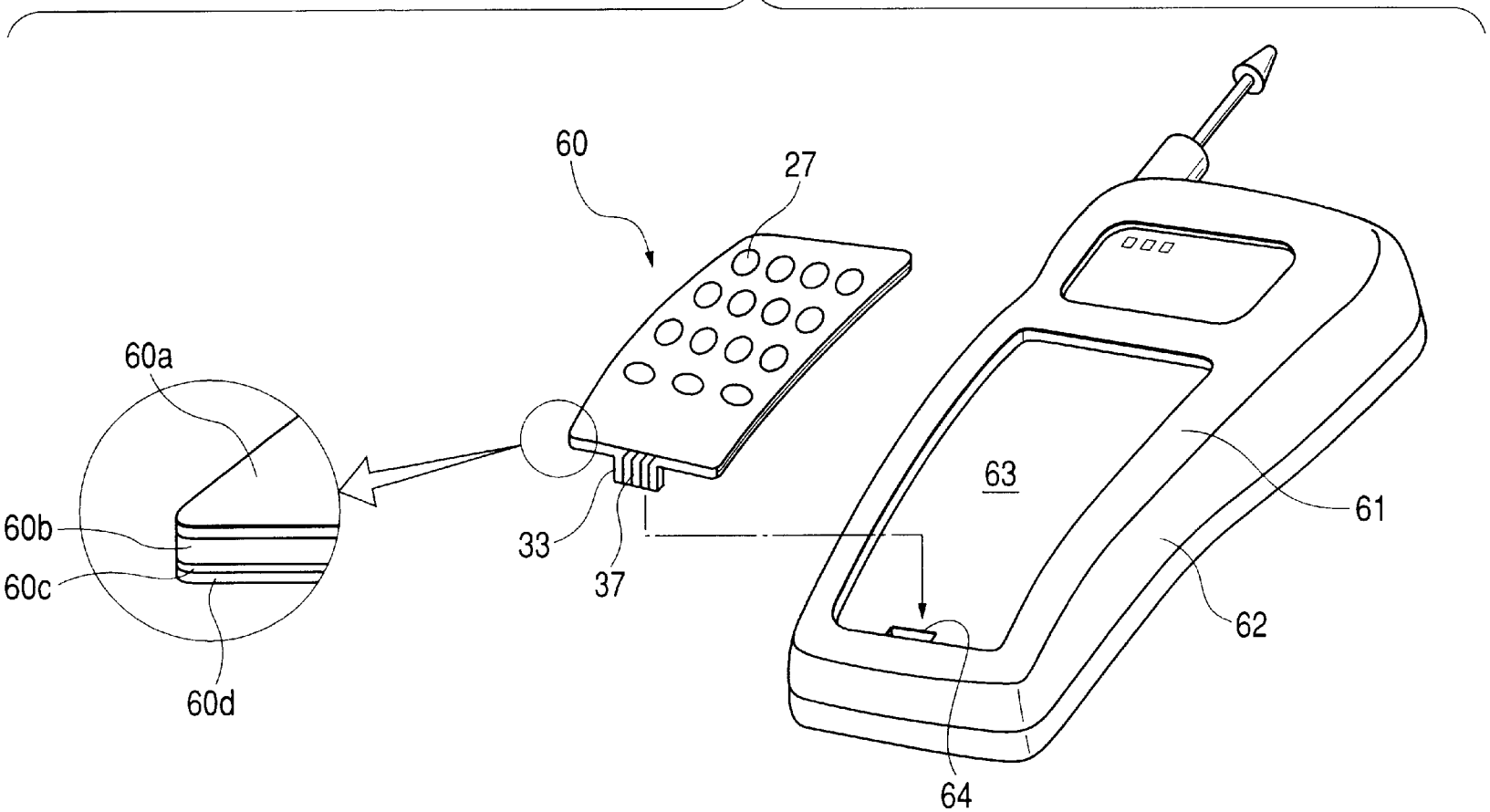
FIG. 25 is an exploded perspective view of a portable cellular telephone, showing a second installation example for a dome switch.

FIG. 25 is an exploded perspective view of a portable cellular telephone, showing a second installation example. In FIG. 25, reference numeral 60 denotes a poly-dome switch which is changed in appearance configuration, design and so on with respect to the poly-dome switch 21 (This poly-dome switch is basically similar to the poly-dome switch 21.). Reference numeral 61 denotes a recess portion (serving as a mounting member) formed in the cellular phone 62.

The poly-dome switch 60 comprises a front sheet 60*a*, a spacer sheet 60*b*, an FPC (circuit member) 60*c*, and an adhesive sheet 60*d*. The poly-dome switch 60 is designed to have flexibility. A plurality of projected portions 27 for being pushed or operated are formed on the front sheet 60*a*. Electrodes (not shown), as well as characters, signs or the like, are printed on an inner face of the front sheet 60*a*. Through holes (not shown), corresponding respectively to the projected portions 27, and air escape portions (not show) are formed through the spacer sheet 60*b*. External connection member 33, comprising edge connector terminals 37, is provided at the FPC 60*c*.

The recess portion 61 has a curved face 63 conforming to the front face of the cellular phone 62. A connection portion 64 for the external connector 33 is formed in this curved face 63.

In the above construction, the poly-dome switch 60 can be mounted relative to the recess portion 61 in the following manner. Namely, the poly-dome switch 60 is curved in accord with a curved condition of the curved face 63, and is bonded to the recess portion 61 through the adhesive sheet 60*d*, and by doing so, the poly-dome switch 60 can be easily mounted at the recess portion 61. At this time, the edge connector terminals 37 of the external connector 33 are connected to the connection portion 64 of the cellular phone 62.

This poly-dome switch 60 has an advantage that the switch operating portion of the cellular phone 62 can be suitably changed according to the need of the user (This construction is effective for an arrangement change and a design change.)

Figure 26:
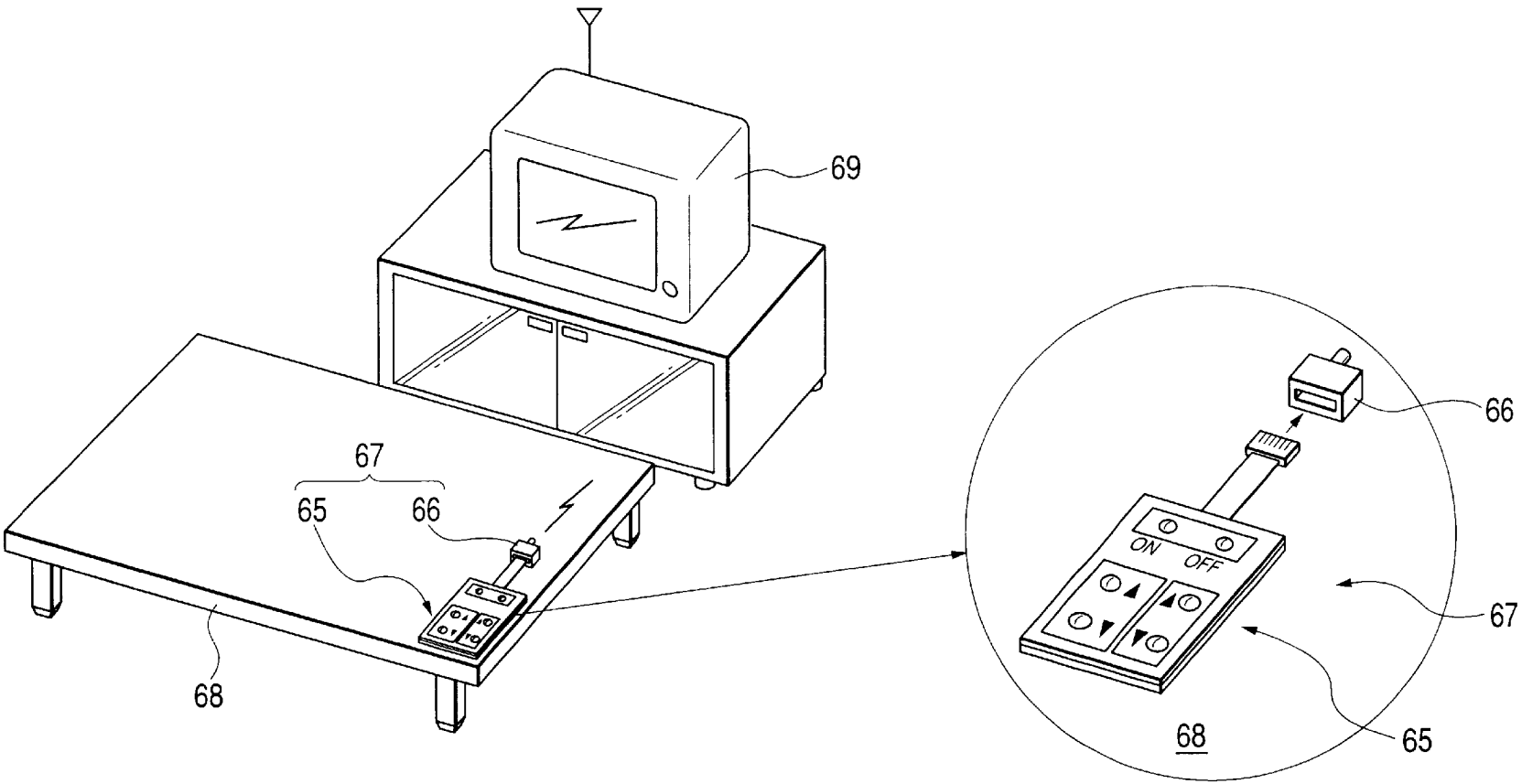
FIG. 26 is a perspective view of a remote control device, showing a third installation example for a dome switch.

FIG. 26 is a perspective view of a remote control device, showing a third installation example. In FIG. 26, reference numeral 65 denotes a poly-dome switch which is changed in appearance configuration, design and so on with respect to the poly-dome switch 21 (This poly-dome switch is basically similar to the poly-dome switch 21.). Reference numeral 66 denotes a remote control unit. In this example, the remote control device 67, comprising the poly-dome switch 65 and the remote control unit 66, is mounted, for example, on a table 68 serving as a mounting member, so that channels and volume of a television set 69 can be adjusted.

Figure 27:
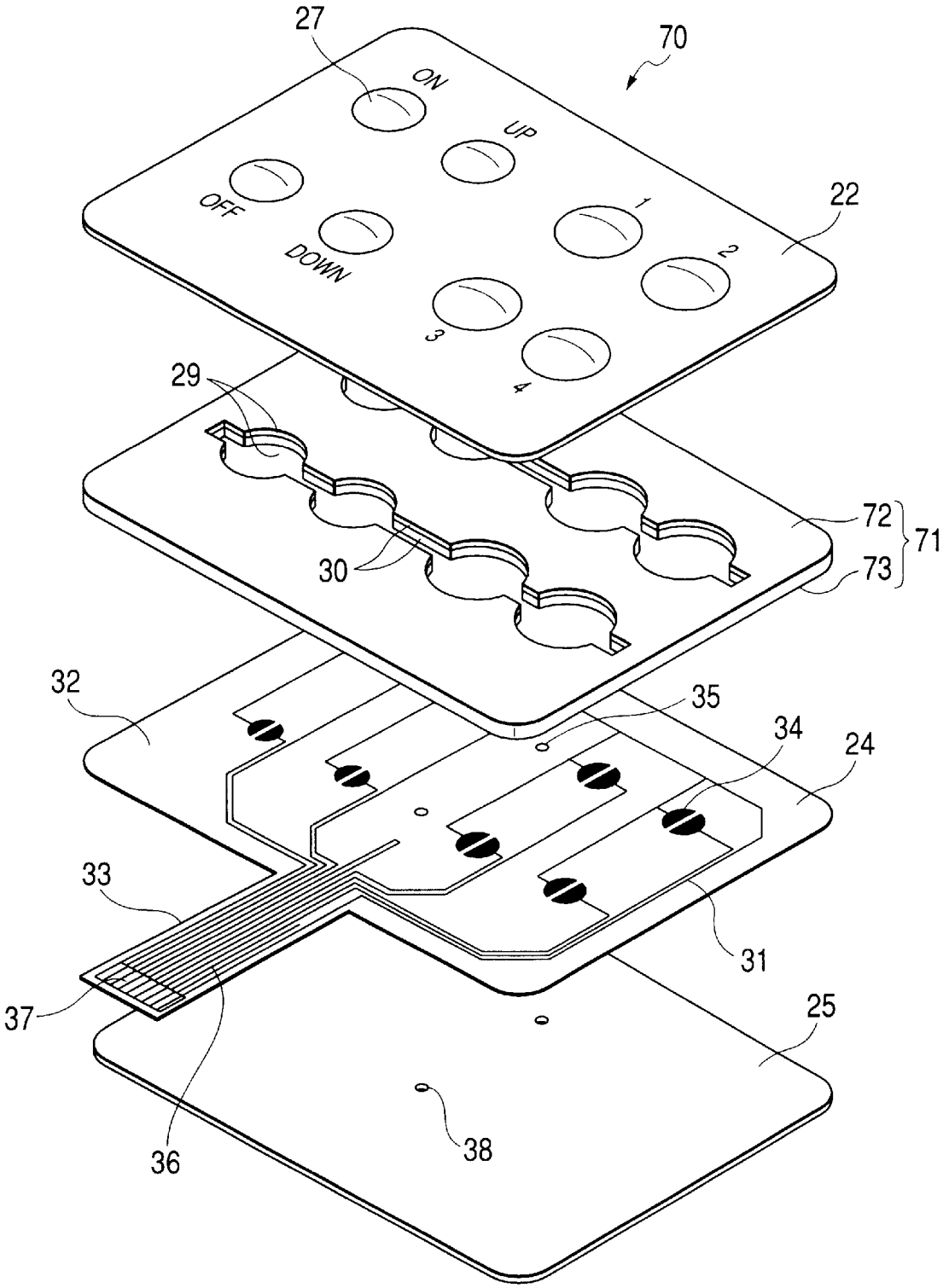
FIG. 27 is an exploded perspective view of a dome switch, showing a second example of the spacer sheet.

FIG. 27 is an exploded perspective view of a dome switch (poly-dome switch), showing a second example of the spacer sheet 23. In FIG. 27, the poly-dome switch, designated at 70, comprises a front sheet 22, a spacer sheet 71, an FPC 24, and an adhesive sheet 25. The spacer sheet 71 comprises an upper spacer sheet 72 and a lower spacer sheet 73.

The spacer sheet 71 is a flexible sheet member made of a synthetic resin such for example as polyethylene terephthalate (PET), and this spacer sheet functions to prevent the deformation of the front sheet 22. The spacer sheet 71 also functions to secure the stroke dimension for projected portions 27.

In the spacer sheet 71, the upper spacer sheet 72 is smaller in thickness than the lower spacer sheet 73. The upper spacer sheet 72 functions as a sheet member for the fine adjustment of the stroke dimension of the projected portions 27. Namely, this spacer sheet 71 is different from the spacer sheet 23 in this respect. In the spacer sheet 71 of this embodiment, the thickness of the upper spacer sheet 72 is 150 $\mu$m, and the thickness of the lower spacer sheet 73 is 300 $\mu$m.

Figure 28:
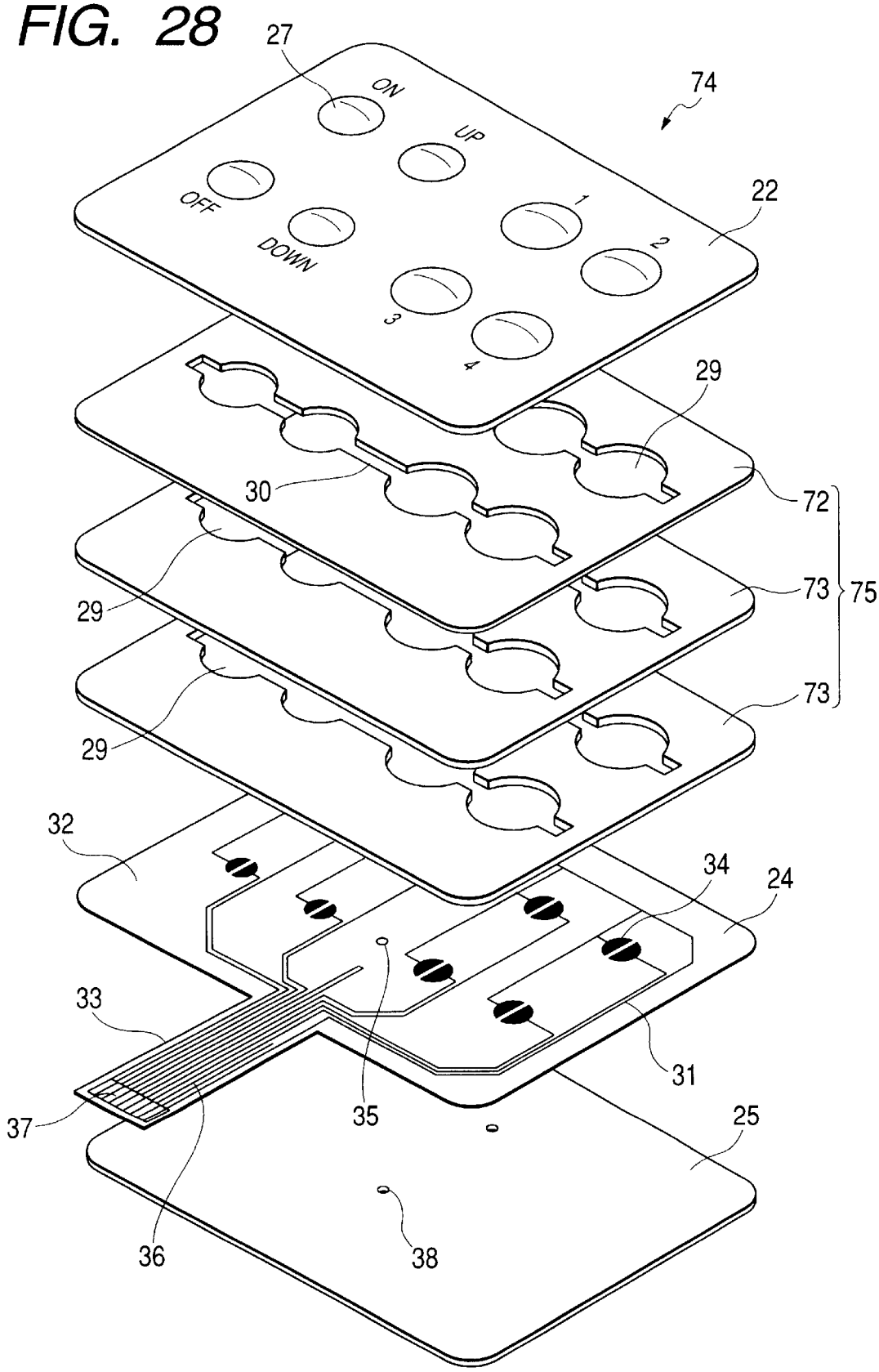
FIG. 28 is an exploded perspective view of a dome switch, showing a third example of the spacer sheet.

FIG. 28 is an exploded perspective view of a dome switch (poly-dome switch), showing a third example of the spacer sheet 23. In FIG. 28, the poly-dome switch, designated at 74, comprises a front sheet 22, a spacer sheet 75, an FPC 24, and an adhesive sheet 25. The spacer sheet 75 comprises an upper spacer sheet 72 and lower spacer sheets 73 (The thickness of the spacer sheet 75, that is, the sum of the thickness of the three sheet layers, is 750 $\mu$m.).

The spacer sheet 75 has the same function as that of the spacer sheet 71, and therefore explanation thereof is omitted.

Figure 29:
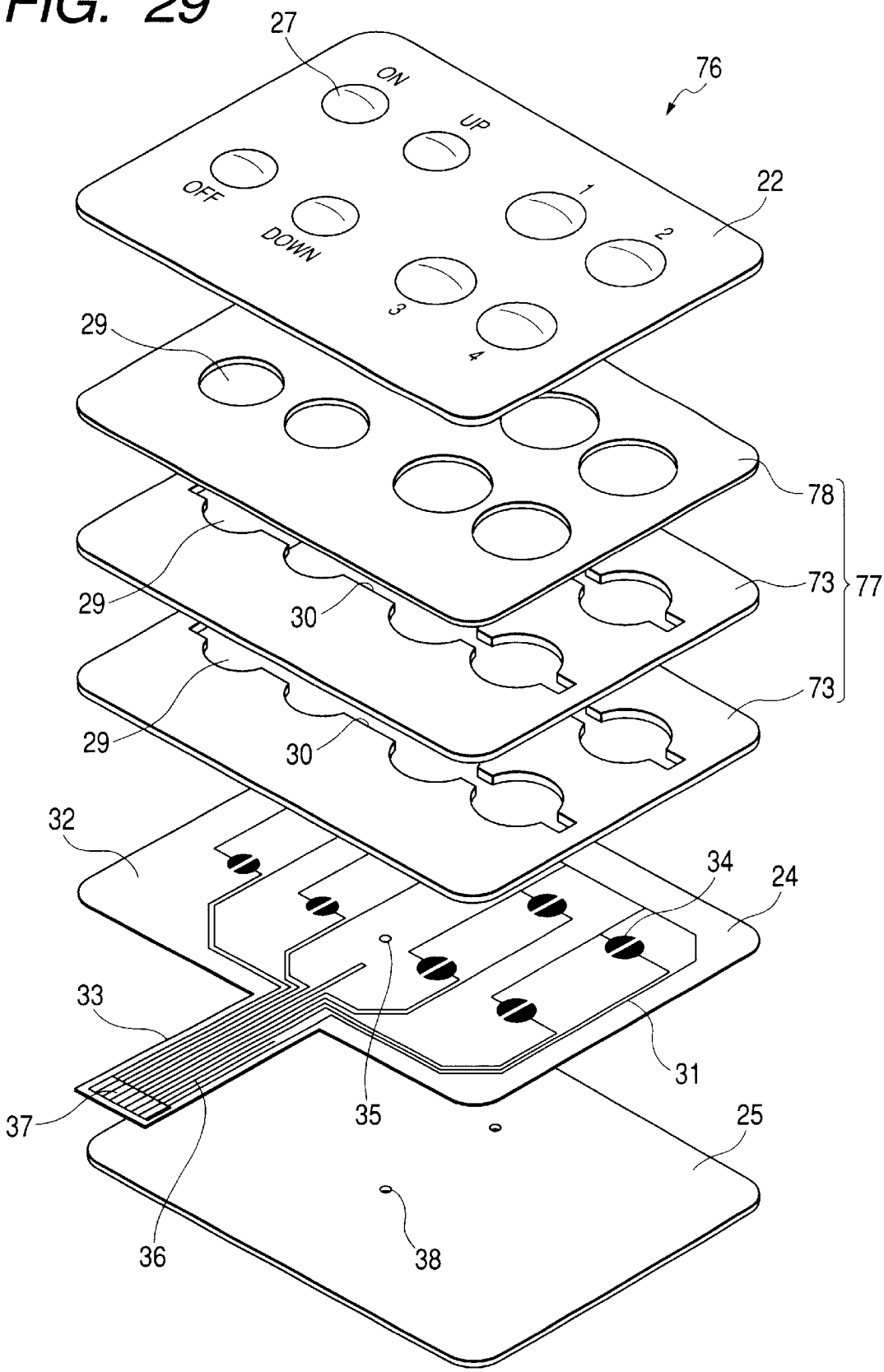
FIG. 29 is an exploded perspective view of a dome switch, showing a fourth example of the spacer sheet.

FIG. 29 is an exploded perspective view of a dome switch (poly-dome switch), showing a fourth example of the spacer sheet 23. In FIG. 29, the poly-dome switch, designated at 76, comprises a front sheet 22, a spacer sheet 77, an FPC 24, and an adhesive sheet 25. The spacer sheet 77 comprises an upper spacer sheet 78 and lower spacer sheets 73 (The thickness of the spacer sheet 77, that is, the sum of the thickness of the three sheet layers, is 750 $\mu$m.).

The upper spacer sheet 78 is identical in construction to the upper spacer sheet 72 except that air escape portions 30 are not provided, and adverse effects of edges, formed at a region where the through hole 29 and the air escape portion 30 are interconnected, are positively eliminated.

Figure 30:
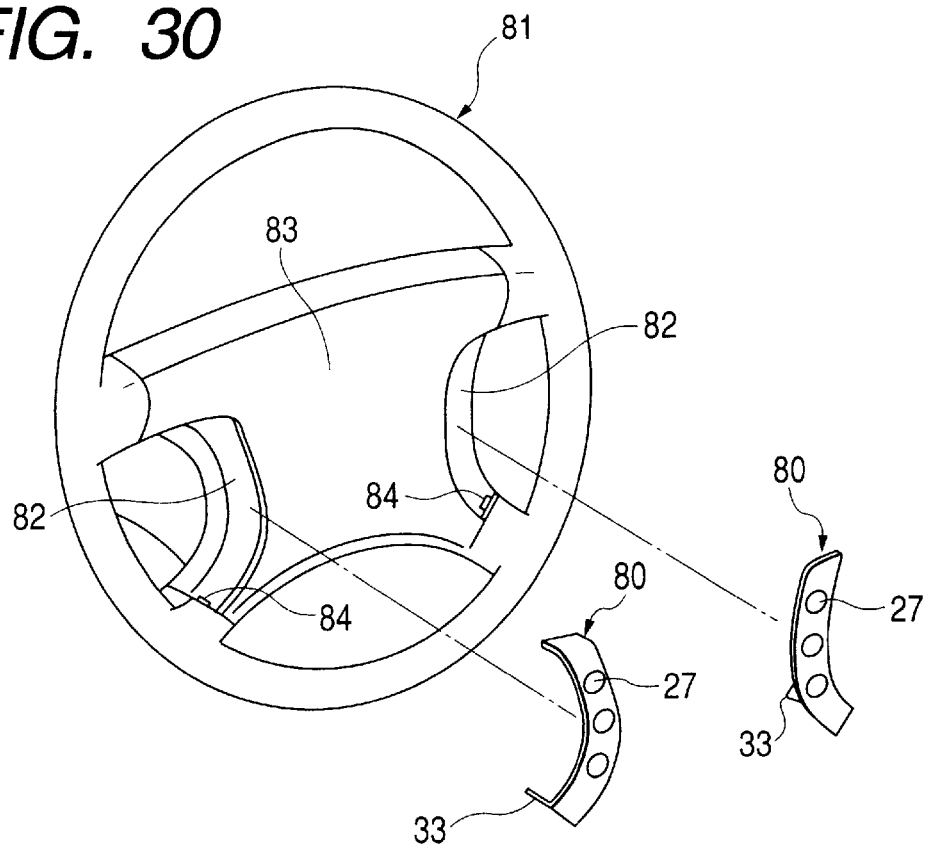
FIG. 30 is a perspective view explanatory of an example in which dome switches are mounted in the vicinity of a horn pad of a steering wheel.

FIG. 30 is a perspective view explanatory of an example in which switches are provided on a steering wheel, and are in the vicinity of a horn pad thereof. In FIG. 30, reference numerals 80 denote the poly-dome switches which are changed in appearance configuration, design and so on with respect to the poly-dome switch 21 (These poly-dome switches are basically similar in construction to the poly-dome switch 21 except that the number of projected portions is smaller and that they have a boomerang-shape.). Reference numeral 81 denotes the steering wheel, and reference numerals 82 denote recess portions (serving as mounting portions) formed in the vicinity of the horn pad 83.

Each of the poly-dome switches 80 comprises a front sheet, a spacer sheet, an FPC (circuit member), and an adhesive sheet. Each of the poly-dome switches 80 is designed to have flexibility. The plurality of projected portions 27 are formed on the front sheet of each poly-dome switch. Characters, signs or the like, are printed on an inner face of the front sheet. Through holes, corresponding respectively to the projected portions 27, and air escape portions, are formed through the spacer sheet of each poly-dome switch. Each FPC has external connector 33.

Each of the recess portions 82 has a boomerang-shape, and has a depth generally equal to the thickness of the poly-dome switch 80 (These recess portions are shallow, and are effective in space-saving.). A smaller through hole 84 for connection purposes, that is, for external connector 33, is formed in each of the recess portions 82.

In the above construction, the poly-dome switches 80 can be mounted relative to the recess portions 82, respectively, in the following manner. Namely, each poly-dome switch 80, while curved in accord with the recess-shape of the recess portion 82, is boned to the recess portion 82 through the adhesive sheet, and by doing so, each poly-dome switch 80 can be easily mounted at the corresponding recess portion 82. At this time, the external connector 33 of each poly-dome switch is connected through the through hole 84 to a wire harness (not shown) or a connection portion (not shown) provided within the steering wheel 81.

Figure 31:
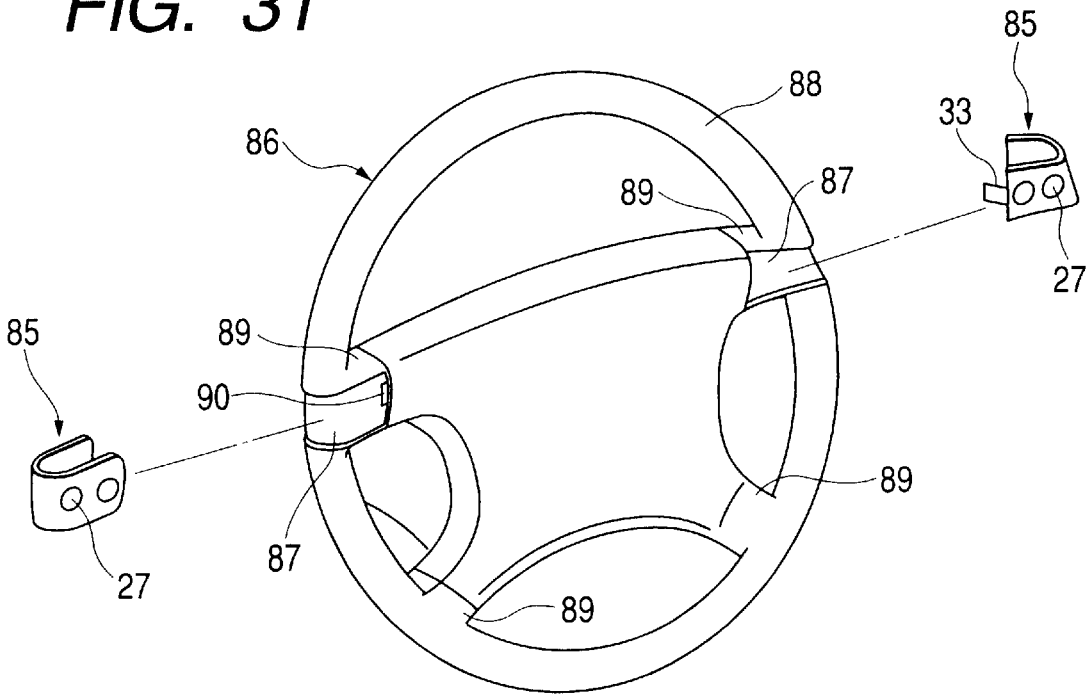
FIG. 31 is a perspective view explanatory of an example in which dome switches are mounted respectively on those portions of a steering wheel each interconnecting a ring thereof and a spoke thereof.

FIG. 31 is a perspective view explanatory of an example in which switches are mounted respectively on those portions of a steering wheel each interconnecting a ring thereof and a spoke thereof. In FIG. 31, reference numerals 88 and 85 denote the poly-dome switches which are changed in appearance configuration, design and so on with respect to the poly-dome switch 21 (These poly-dome switches are basically similar in construction to the poly-dome switch 21 except that the number of projected portions is smaller and that they have a rectangular shape.). Reference numeral 86 denotes the steering wheel, and reference numerals 87 denote recess portions (serving as mounting portions) formed in those portions of the steering wheel each interconnecting the corresponding ring 88 and spoke 89.

Each of the poly-dome switches 85 comprises a front sheet, a spacer sheet, an FPC (circuit member), and an adhesive sheet. Each of the poly-dome switches 85 is designed to have flexibility. The plurality of projected portions 27 are formed on the front sheet of each poly-dome switch. Characters, signs or the like, are printed on an inner face of the front sheet. Through holes, corresponding respectively to the projected portions 27, and air escape portions, are formed through the spacer sheet of each poly-dome switch. External connection member 33 (only one of which is shown) is provided at each FPC.

Each of the recess portions 87 and 88 has a U-shape, and has a depth generally equal to the thickness of the poly-dome switch 85 (These recess portions are shallow, and are effective in space-saving.). A smaller through hole 90 for connection purposes, that is, for the external connector 33 (only one of which is shown), is formed in each of the recess portions 87.

In the above construction, the poly-dome switches 85 can be mounted relative to the recess portions 87, respectively, in the following manner. Namely, each poly-dome switch 85, while curved into a U-shape corresponding to the recess-shape of the recess portion 87, is boned to the recess portion 87 through the adhesive sheet, and by doing so, each poly-dome switch 85 can be easily mounted at the corresponding recess portion 87. At this time, the external connector 33 of each poly-dome switch is connected through the through hole 90 to a wire harness (not shown) or a connection portion (not shown) provided within the steering wheel 86.

Alternatively, the whole of each of the poly-dome switches 85 is beforehand deformed or processed into the U-shape as illustrated, and thereafter the poly-dome switch is bonded to the recess portion 87 through the adhesive sheet, and by doing so, each of the poly-dome switches 85 can be easily mounted at the corresponding recess portion 87. In case the whole of each of the poly-dome switches 85 is beforehand deformed or processed into the required shape, and then is bonded to the recess portion 87, each of the dome switches 85 can be formed, using the adhesive sheet having a minimum necessary adhesive strength. And besides, each of the poly-dome switches 85 can be mounted more easily as compared with the case where each poly-dome switch, while curved into the U-shape, is bonded.

A membrane switch of the seventh embodiment according to the present invention will be described with reference FIG. 32 to FIG. 34 Incidentally, in the membrane switch 321, components as same as the components described in the above embodiments are appended same reference numerals, and the detailed explanations regarding to the components are omitted.

Figure 32:
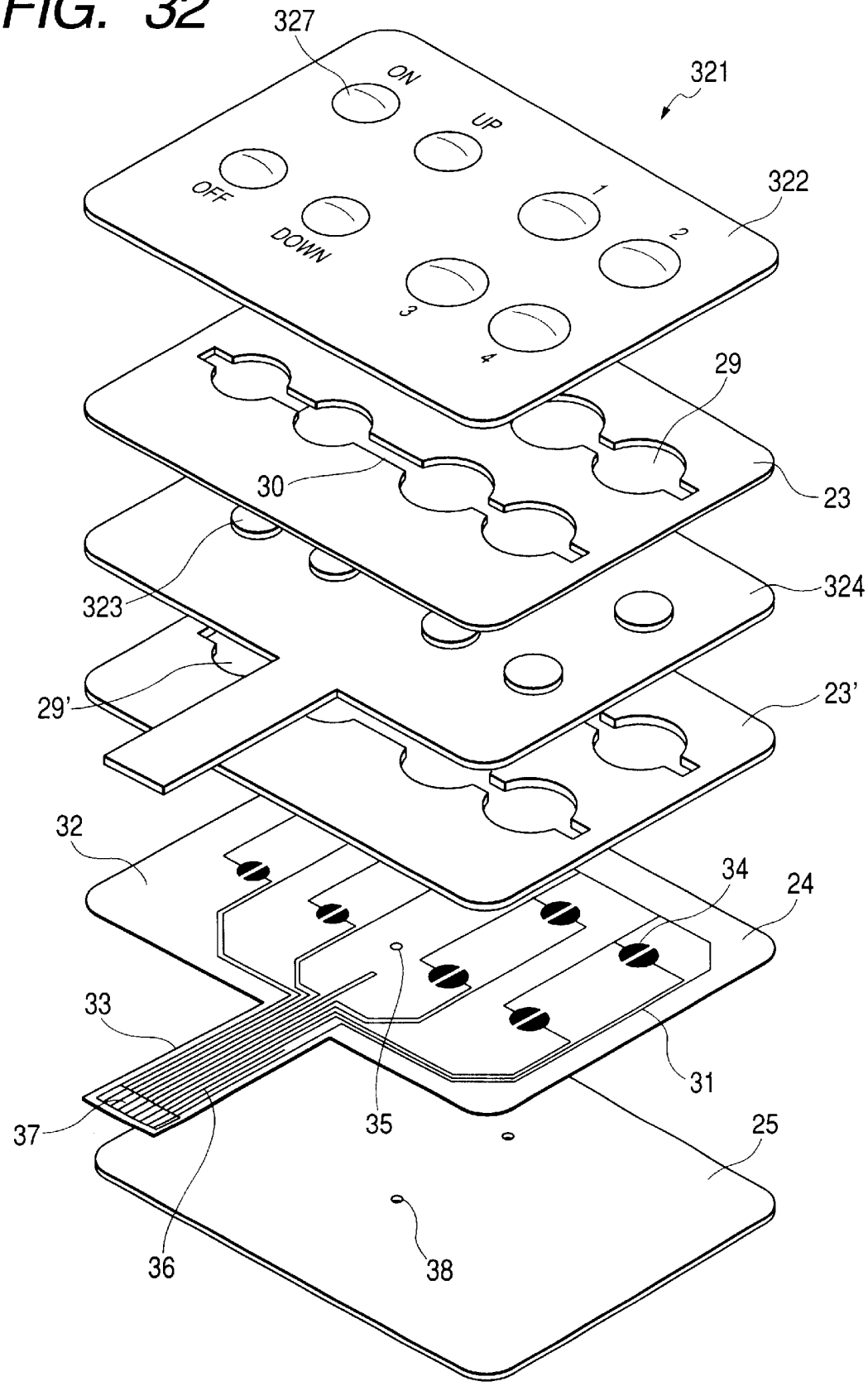
FIG. 32 is an exploded perspective view of a membrane switch of the present invention.
Figure 33:
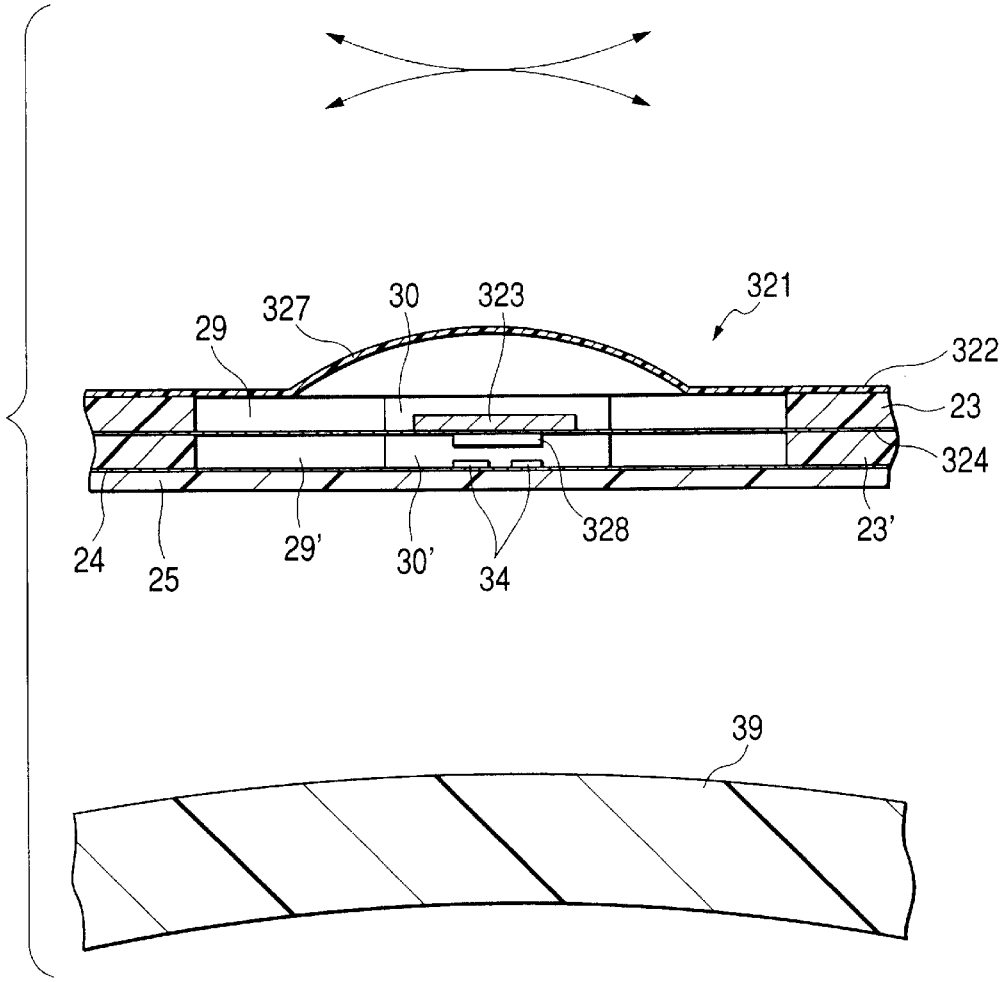
FIG. 33 is a cross-sectional view explanatory of the flexibility of the membrane switch.

In FIGS. 32 and 33, the membrane switch 321 comprises a front sheet 322, a spacer sheet 23, an first FPC 24, a spacer sheet 23', a second FPC 324, and an adhesive sheet 25. Incidentally, the spacer sheet 23 is identical with the spacer sheet 23'.

The front sheet 322 is transparent, and has flexibility, and a plurality of projected portions 327. The front sheet 322 is identical with the front sheet 22 of the dome switch 21 according to the first embodiment except that the electrode 28 is not provided at an apex of in inner face of the front sheet 22. The FPC 324, having a flexibility, has a plurality of elastic members 323 and a plurality of electrodes 328. The elastic members 323 disposed at a position corresponding to the projected portions 327 are provided on a observe face of the FPC 324. The elastic member 323 is made of such as elastomer and rubber. The electrodes 328 disposed at a position corresponding to the projected portions 327 are provided on a reverse face of the FPC 324.

Next, the membrane switch 321 is assembled in the following manner. First, the front sheet 322 is adhesively bonded to the obverse face of the spacer sheet 23, and the FPC 324 is adhesively bonded to the reverse face of the spacer sheet 23. Next, the FPC 324 is adhesively bonded to the obverse face of the spacer sheet 23', and the FPC 24 is adhesively bonded to the reverse face of the spacer sheet 23'. Then, this laminate is affixed to the adhesive sheet 25, with the FPC 24 adhesively bonded to the circuit member-mounting face of the adhesive sheet 25, thereby assembling the membrane switch 321.

Next, the operation of the membrane switch 321, mounted on a flat mounting member 39, will be described with reference to FIG. 34.

Figure 34:
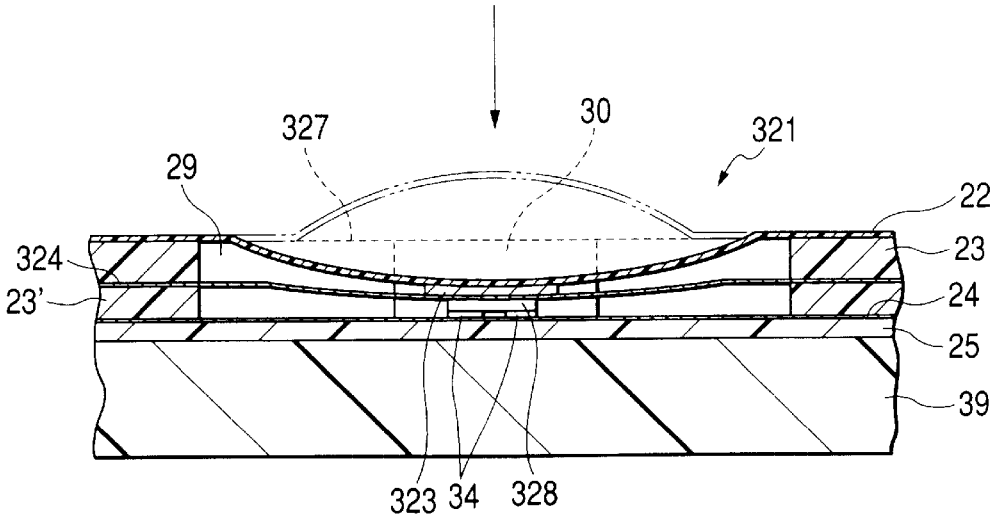
FIG. 34 is a cross-sectional view of the membrane switch in an operated condition.
Figure 35:
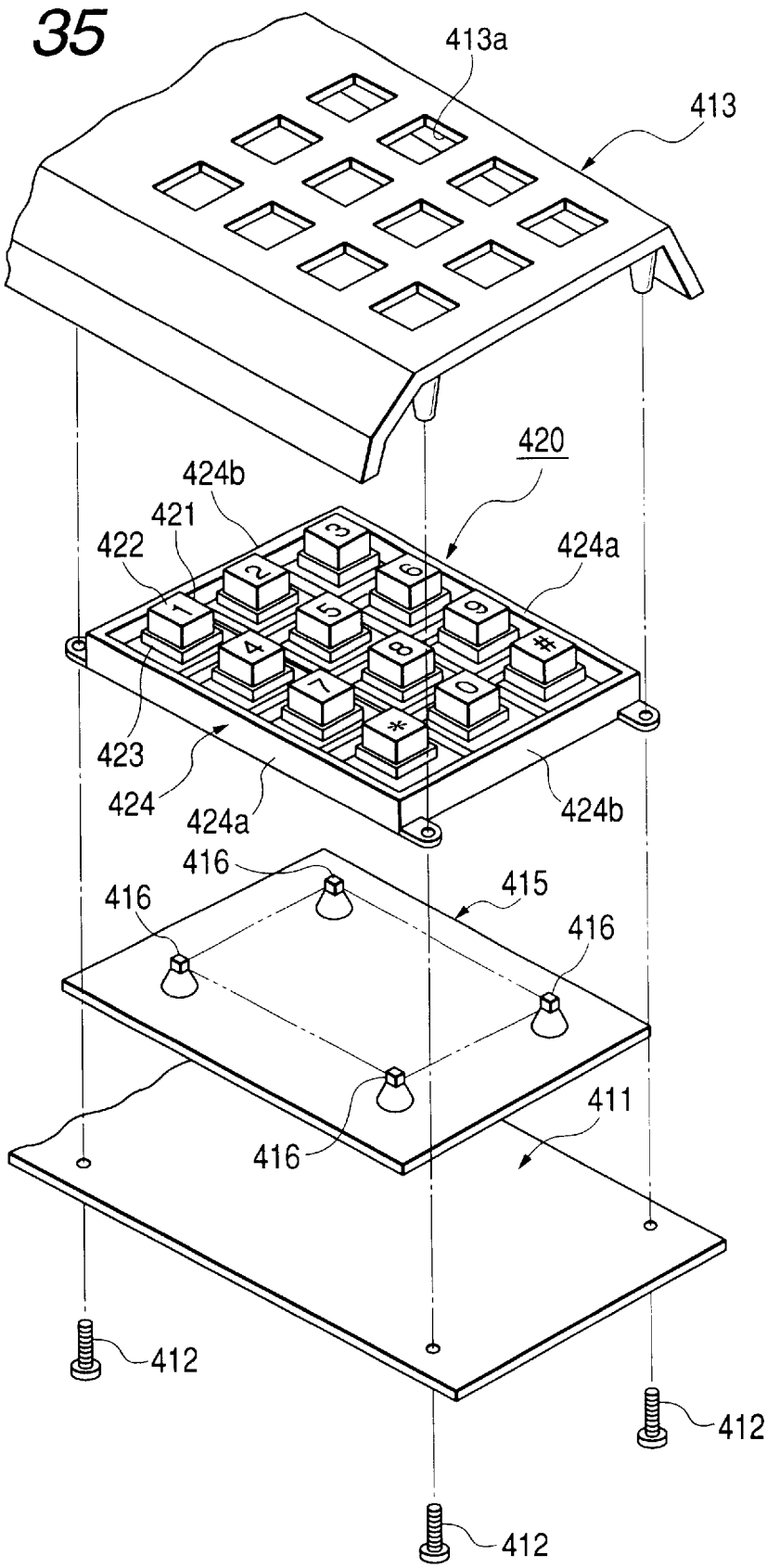
FIG. 35 is an exploded perspective view showing the construction of a related switch.
Figure 36:
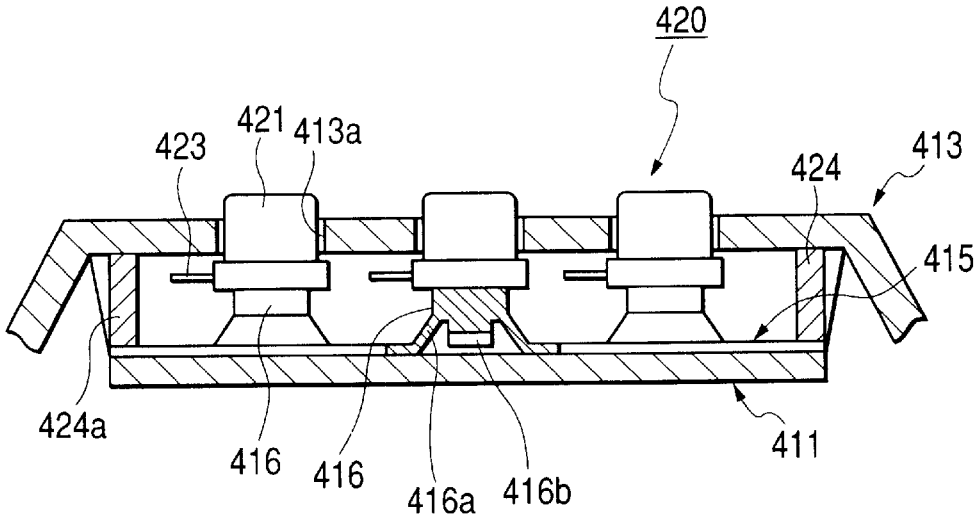
FIG. 36 is a cross-sectional view showing the construction of the related switch.
Figure 37:
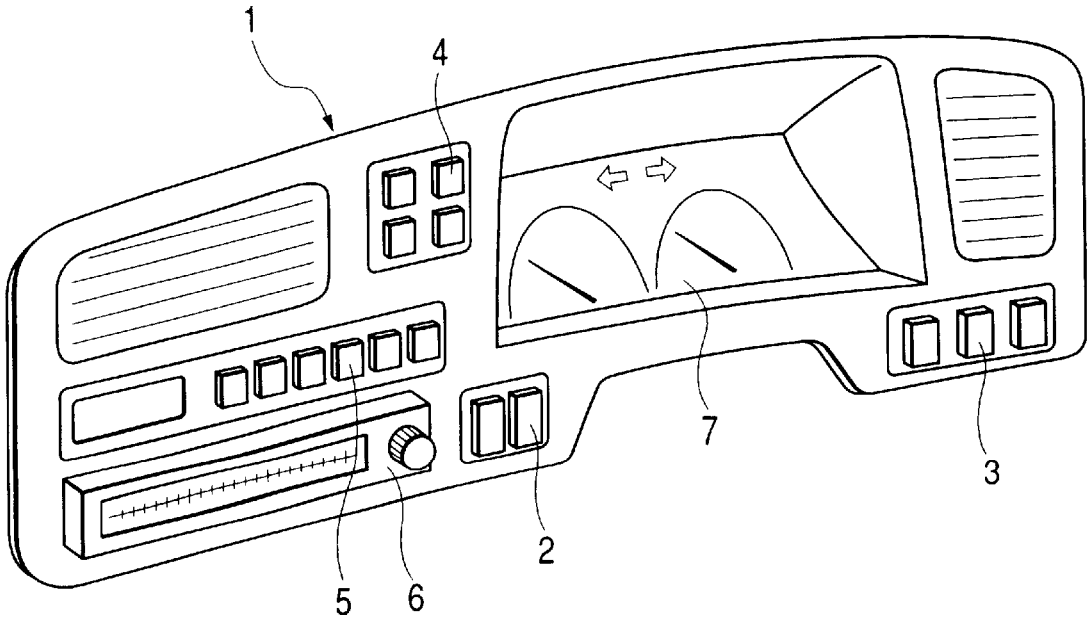
FIG. 37 is a perspective view of an instrument panel on which a related switch is mounted.
Figure 38:
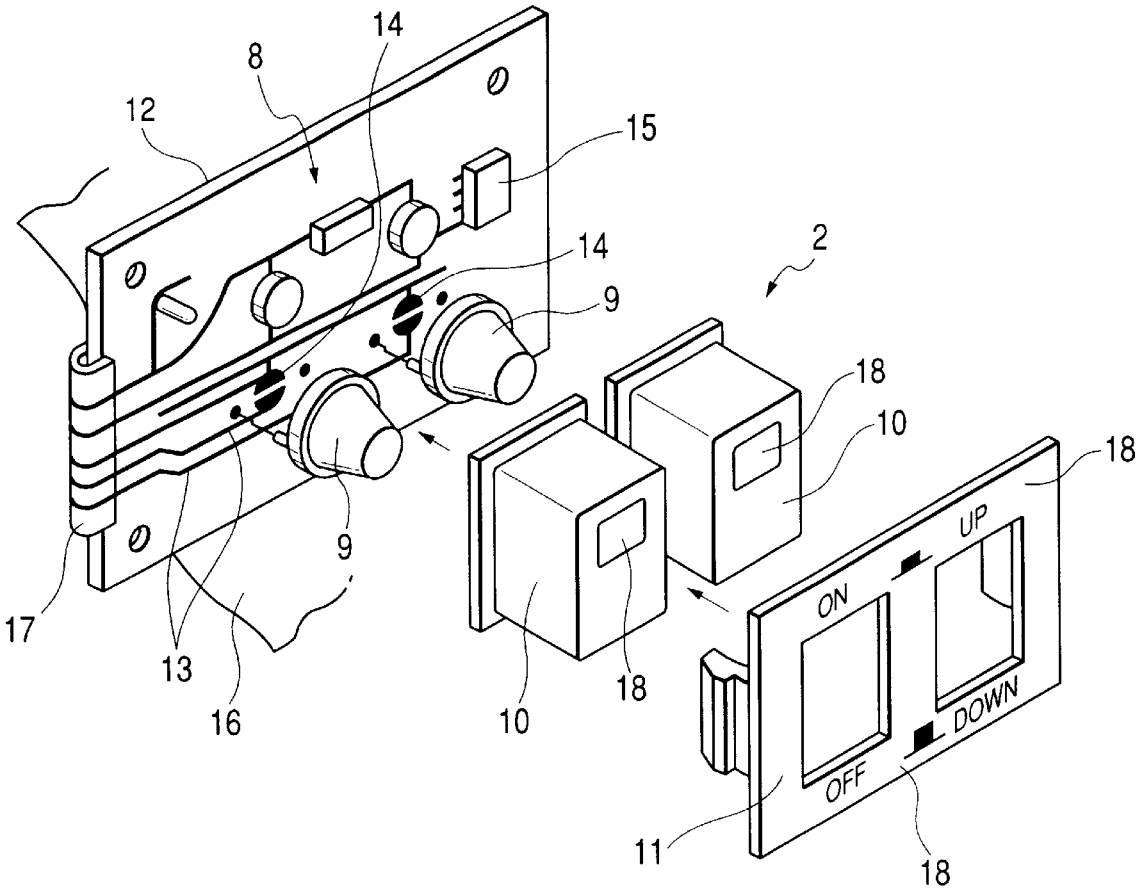
FIG. 38 is an exploded perspective view showing the construction of the related switch.

When, the switch is operated, the projected portion 327 is depressed in a direction of an arrow in FIG. 34 (a load is applied in the direction of the arrow), the projected portion 327 resists the load, acting in the direction of the arrow, and then is buckled to be inverted when this load exceeds a certain value (At this time, a click feeling is obtained). When the projected portion 327 is buckled and inverted, the load, acting in the direction of the arrow, decreases, so that the depressing of the projected portion 327 proceeds smoothly. The inverted projected portion 327 passes through the through hole 29 in the spacer sheet 23, and depress the elastic member 323 of the FPC 324 so that the FPC 324 is bended. Then, the electrode 328 provided on the FPC 324 is brought into contact with the contact 34 (see FIG. 32) on the FPC 24 through the through hole 29'.

As a result, the circuits 31 (see FIG. 32) are rendered conductive, and the membrane switch 321 is turned on. On the other hand, when the application of the load in the direction of the arrow is canceled, the projected portion 327 is restored into its original shape. As a result, the conductive condition is canceled, so that the membrane switch 321 is turned off. Incidentally, the configuration according to this embodiment can be combined with the configuration such as design portions 26, 26', 102, 112, 122 explained with the second embodiment to the sixth embodiment.

Accordingly, the membrane switch 321 can achieve the same advantages as described with reference to the previous embodiments. Of course, the configuration according to this embodiment can be combined with the configuration explained with FIGS. 16 to 31.

Although the present invention has been shown and described with reference to specific preferred embodiments, various changes and modifications will be apparent to those skilled in the art from the teachings herein. Such changes and modifications are obvious and deemed to come within the spirit, scope and contemplation of the invention as defined in the appended claims.

What is claimed is:

1. A flexible switch, comprising:

an adhesive sheet;

a circuit member, provided on the adhesive sheet, and having an electrode;

a spacer sheet, provided on the circuit member, and having a through hole situated so as to correspond to the electrode on the circuit member; and a front sheet, provided on the spacer sheet, and having a projected portion, in which a contact portion provided on an inner face of the projected portion is brought into contact with the electrode through the through hole in the circuit member when the projected portion is depressed; and wherein at least one of the adhesive sheet, the circuit member, the spacer sheet, and the front sheet has flexibility.

2. The flexible switch as set forth in claim 1, wherein a form of the projected portion is shaped into a hemisphere.

3. The flexible switch as set forth in claim 1, further comprising an external connection member, for electrically connecting the circuit member to an external member, and the external connection member provided on the circuit member.

4. The flexible switch as set forth in claim 3, wherein the external member is at least one of an automotive component and an automotive accessory.

5. The flexible switch as set forth in claim 3, wherein the external connection member includes at least one of an edge connector terminal and a connector.

6. The flexible switch as set forth in claim 4, wherein the external connection member includes a wire connection circuit portion.

7. The flexible switch as set forth in claim 1, wherein the circuit member is provided on a first face of the adhesive sheet; and wherein a second face of the adhesive sheet opposed to the first face is covered with a release paper sheet.

8. The flexible switch as set forth in claim 1, wherein the front sheet is transparent.

9. The flexible switch as set forth in claim 1, wherein the front sheet is provided with an compatible external appearance portion; and wherein the compatible external appearance portion is provided on at least one of an inner face and an outer face of the front sheet.

10. The flexible switch as set forth in claim 1, wherein at least one flat member situated so as to correspond to the through holes is provided on the front sheet.

11. The flexible switch as set forth in claim 9, wherein the front sheet is transparent; and wherein the compatible external appearance portion, formed on the inner face of the front sheet, is at least one of a printed portion and an ornamented portion.

12. The flexible switch as set forth in claim 9, wherein the compatible external appearance portion includes a coating layer made of a synthetic resin; and wherein the coating layer is formed on the projected portion of the front sheet.

13. The flexible switch as set forth in claim 9, wherein the compatible external appearance portion includes a sheet cover member and a depressing portion;

wherein the sheet cover member covers the outer face of the front sheet;

wherein the depressing portion is integrally formed with the sheet cover member; and wherein the projected portion is accommodated in an inner side of the depressing portion.

14. The flexible switch as set forth in claim 1, wherein the front sheet serves for a bezel.

15. A method for producing a flexible switch, comprising the steps of:

providing an adhesive sheet, a circuit member having an electrode, and a spacer sheet having a through hole situated so as to correspond to the electrode on the circuit member, used respectively as common members; and providing a first compatible front sheet having a first projected portion and a first external appearance;

providing a second compatible front sheet having a second projected portion and a second external appearance different from the first external appearance;

selecting either the first compatible front sheet or the second compatible front sheet in accordance with a design change and a model change;

mounting the circuit member on the adhesive sheet;

mounting the spacer sheet on the circuit member; and mounting either the first compatible front sheet or the second compatible front sheet which is selected in the selecting step accordance with the design change and the model, on the spacer sheet.

* * * * *